US007394010B2

(12) United States Patent
Nishibori et al.

(10) Patent No.: US 7,394,010 B2
(45) Date of Patent: Jul. 1, 2008

(54) PERFORMANCE APPARATUS AND TONE GENERATION METHOD THEREFOR

(75) Inventors: Yu Nishibori, Hamamatsu (JP); Toshio Iwai, Mitaka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 11/493,739

(22) Filed: Jul. 26, 2006

(65) Prior Publication Data

US 2007/0022868 A1 Feb. 1, 2007

(30) Foreign Application Priority Data

Jul. 29, 2005 (JP) ..... 2005-221952
Oct. 6, 2005 (JP) ..... 2005-293369

(51) Int. Cl.

| | |
|---|---|
| ***A63J 17/00*** | (2006.01) |
| ***G10H 7/00*** | (2006.01) |
| ***G10H 1/34*** | (2006.01) |
| ***G10H 1/06*** | (2006.01) |
| ***G10H 1/02*** | (2006.01) |

(52) U.S. Cl. ..... 84/464 A; 84/602; 84/622; 84/626; 84/745

(58) Field of Classification Search ..... 84/601, 84/602, 603, 604, 464 A, 464 R, 744, 745, 84/622, 626

See application file for complete search history.

(56) References Cited

U.S. PATENT DOCUMENTS

| | | | | |
|---|---|---|---|---|
| 3,562,394 | A | 2/1971 | Keipe | |
| 4,031,800 | A | 6/1977 | Thompson | |
| 4,089,246 | A | 5/1978 | Kooker | |
| 4,123,960 | A | 11/1978 | Franzmann | |
| 4,384,503 | A * | 5/1983 | Gunn | 84/653 |
| 4,422,365 | A | 12/1983 | Iwaki | |

(Continued)

FOREIGN PATENT DOCUMENTS

DE 100 42 300 A1 3/2002

(Continued)

OTHER PUBLICATIONS

Korg Kaoss Pad KP2 Owner's Manual. 2002.*

(Continued)

*Primary Examiner*—Lincoln Donovan
*Assistant Examiner*—Andrew R Millikin
(74) *Attorney, Agent, or Firm*—Rossi, Kimms & McDowell LLP

(57) ABSTRACT

A Plurality of key switches for tone-generating are arranged two-dimensionally. Mode setting section sets a tone adjusting mode in which the key switches are caused to function as tone-adjusting operators. In the tone adjusting mode, adjustment of a predetermined tone factor (e.g., tone pitch, tone length, tone volume or tone color) is permitted in response to operation of the key switch. For example, once a user moves a finger to change a Y-coordinate position of the key switch in the tone adjusting mode, an amount of the movement, i.e. a difference between Y-coordinates of two or more successively-operated key switches, is detected, and the thus-detected movement amount is set as a value for adjusting a tone volume or the like. All of light-emitting elements located at Y-coordinate positions of the key switches may be illuminated in a line, to allow the user to visually confirm the adjustment and operation.

21 Claims, 14 Drawing Sheets

U.S. PATENT DOCUMENTS

| | | | |
|---|---|---|---|
| 5,027,689 | A | 7/1991 | Fujimori |
| 5,088,378 | A | 2/1992 | DeLaTorre |
| 5,247,864 | A | 9/1993 | Konishi |
| 5,530,898 | A | 6/1996 | Miyake |
| 5,665,927 | A | 9/1997 | Taki et al. |
| 5,684,259 | A | 11/1997 | Horii |
| 5,741,990 | A | 4/1998 | Davies |
| 5,831,195 | A | 11/1998 | Nakata |
| 5,908,997 | A | 6/1999 | Arnold et al. |
| 5,936,180 | A | 8/1999 | Ando |
| 6,160,213 | A | 12/2000 | Arnold et al. |
| 6,179,432 | B1 | 1/2001 | Zhang et al. |
| 6,347,998 | B1 | 2/2002 | Yoshitomi et al. |
| 6,670,535 | B2 | 12/2003 | Anderson et al. |
| 2002/0105359 | A1 | 8/2002 | Shimizu et al. |
| 2002/0134223 | A1 | 9/2002 | Wesley |
| 2003/0015087 | A1 | 1/2003 | Haken |
| 2006/0005693 | A1 | 1/2006 | Nishibori et al. |
| 2006/0236846 | A1 | 10/2006 | Nishibori |
| 2007/0022865 | A1 | 2/2007 | Nishibori et al. |

FOREIGN PATENT DOCUMENTS

| | | | |
|---|---|---|---|
| EP | 0632427 | A2 | 1/1995 |
| EP | 1710784 | A1 | 11/2006 |
| EP | 1748415 | A2 | 1/2007 |
| EP | 1748418 | A1 | 1/2007 |
| JP | 53-028414 | | 3/1978 |
| JP | 02-074997 | A | 3/1990 |
| JP | 03-182798 | A | 8/1991 |
| JP | 4-285765 | A | 10/1992 |
| JP | 7-325579 | A | 12/1995 |
| JP | 08-006549 | A | 1/1996 |
| JP | 8-110826 | A | 4/1996 |
| JP | 08-221074 | A | 8/1996 |
| JP | 09-068980 | A | 3/1997 |
| JP | 09-212157 | A | 8/1997 |
| JP | 09-319362 | A | 12/1997 |
| JP | 10-097251 | A | 4/1998 |
| JP | 2001-009152 | A | 1/2001 |
| JP | 2002-175080 | A | 6/2002 |
| JP | 2002-229567 | A | 8/2002 |
| JP | 2003-177754 | A | 6/2003 |
| JP | 2004-271783 | A | 9/2004 |
| JP | 2004-274570 | A | 9/2004 |

OTHER PUBLICATIONS

Korg Kaoss Pad KP2 Website. Accessed May 23, 2007. <http://www.korg.com/gear/info.asp?a__prod__no=KPS>.*

Notice of Grounds for Rejection issued in corresponding Japanese Patent Application No. 2005-109595, with mailing date Feb. 27, 2007.

Notice of Preliminary Rejection issued for corresponding Korean Patent Application No. 10-2006-0031407, dated Jan. 24, 2007.

Extended European Search Report issued for corresponding European Patent Application No. 06007180.0-2218, dated Jul. 27, 2006.

Notice of Grounds for Rejection issued in corresponding Japanese Patent Application No. 2005-293369, with mailing date Feb. 27, 2007.

Extended European Search Report of corresponding European Patent Application No. 06015696.5-2218 dated Nov. 20, 2006.

Keitai News, (on-line), Jan. 16, 2002, available at http://k-tai.ascii24.com/k-tai/news/2002/01/16/632762-000.html, with its English translation, accessed on Feb. 23, 2006.

World of Digista Curator, (on-line), Digital Stadium, Toshio Iwai, with its English translation, accessed on Mar. 29, 2006.

Propellerhead Reason Operation Manual. Ludvig Carlson, Anders Nodrmark, and Roger Wiklander. 2000. Cited in related co-pending U.S. Appl. 11/398,979.

Office Action issued on Nov. 17, 2006 in Japanese Patent Application No. 2004-200689, from which related co-pending U.S. Appl. No. 11/176,645 claims proprity.

Office Action issued on Nov. 17, 2006 in Japanese Patent Application No. 2004-200690, from which related co-pending U.S. Appl. No. 11/176,645 claims priority.

Hajime Tachibana Design and NTT Learning systems Corporation released i-Appli that changes cellular phone to music sequencer; disclosed in "Keitai News" on Jan. 16, 2002.

"TENORI-ON" disclosed in "The World of Digital Stadium Curator", pp. 1-7, on the internet (www.nhk.or.jp/digista/lab/digista__ten/curator.html).

Japanese Office Action (Decision of Rejection) issued Jan. 30, 2007 in Japanese Patent Application No. 2004-200690 from which related co-pending U.S. Appl. No. 11/176,645 claims priority.

European Search Report for European Patent Application No. EP 06015695 which corresponds to related co-pending U.S. Appl. No. 11/495,467; mailing date of Feb. 6, 2007; pp. 2-12.

Partial European Search Report of European Patent Application No. 06015695 which corresponds to related co-pending U.S. Appl. No. 11/495,467; mailing date of Oct. 26, 2006.

"Yamaha's Tenori-On LED-panel instrument", retrieved from http://www.engadget.com, Weblogs, Inc, 2003-2007.

"Keitai News", retrieved from http://k-tai.ascii24.com/k-tai/new/2002/01/16/632762-000.html, on Jan. 16, 2002.

"World of Digista Curator" Digital Stadium, Toshio Iwai.

"TENORI-ON", retrieved from http://www.global.yahama.com/design.

Office Action issued in European application No. EP 07103475.5, mailed on Jul. 13, 2007 which corresponds to related co-pending U.S. Appl. No. 11/681, 899.

Specification and drawings of related co-pending unpublished U.S. Appl. No. 11/681,899 filed Mar. 5, 2007; Performance Apparatus and Tone Generation Method; Yu Nishibori et al.; pp. 1-60.

Notice of Grounds for Rejection issued in corresponding Japanese Patent Appl. No. 2005-293369 from which the present application claims priority. Mailing date: Jun. 19, 2007.

Extended European search report issued Nov. 13, 2007 in corresponding European patent applicaiton EP07103475.5; pp. 1-14. This European application corresponds to related co-pending patent application No. 11/681,899.

* cited by examiner

PERFORMANCE APPARATUS AND TONE GENERATION METHOD THEREFOR

BACKGROUND OF THE INVENTION

The present invention relates to performance apparatus which receives user's operation of a plurality of key switches and execute a performance in response to the user's operation of the key switches, as well as tone generation methods for the performance apparatus.

Application program called "TENORI-ON" has been known, for example, from

Non-patent Literature 1: "Keitai News" [online], Jan. 16, 2002, ADSCII, [searched on Apr. 1, 2004], the Internet website http://k-tai.ascii24.com./k-tai/news/2002/01/16/632762-000.html?geta, and Non-patent Literature 2: "World of Digista Curator" [online], Digital Stadium, Toshio Iwai, Exhibit=TENORI-ON, [searched on Apr. 1, 2004], the Internet website http://www.nhk.or.jp/digista/lab/digista_ten/curator.html.

In performance apparatus, such as those for portable phones and game apparatus, each user's input designating a particular point is received on 16×16 grids that are arranged in a matrix configuration with the horizontal axis representing the timing and the vertical axis representing the tone pitch. These performance apparatus sequentially generate tone pitches corresponding to user-designated points from left-most columns. In this way, the users can use the performance apparatus to compose and perform simple music pieces with enhanced elaborateness and originality.

In the aforementioned conventional performance apparatus, tone generating data is preset per designatable point, and tone pitches corresponding to the designatable points are fixed on the basis of these presettings. Thus, with the conventional performance apparatus, tone pitch adjustment, such as octave change, can not be performed with ease during a performance of a music piece.

Further, in the aforementioned conventional performance apparatus, a tone volume is fixed, during a performance of a music piece, on the basis of a tone volume preset by a volume adjustment section. Because the volume adjustment section adjusts the output tone volume of the performance apparatus, it is difficult to perform fine tone volume adjustment. Thus, with the conventional performance apparatus, fine (delicate) tone volume adjustment can not be performed with ease during a performance of a music piece.

Further, in the aforementioned conventional performance apparatus, tone lengths set between rows of the two-dimensionally-arranged designatable points are also fixed, and thus, tone length adjustment can not be performed with ease during a performance of a music piece.

SUMMARY OF THE INVENTION

In view of the foregoing, it is an object of the present invention to provide a performance apparatus and tone generation method therefor which can readily adjust tone characteristics, such as a tone pitch, volume and length, to be adjusted with ease even during a performance of a music piece.

In order to accomplish the above-mentioned object, the present invention provides an improved performance apparatus, which comprises: a plurality of key switches arranged two-dimensionally; a memory storing tone data corresponding to the plurality of key switches; a tone generation section that, on the basis of the tone data stored in the memory, generates a tone corresponding to a key switch operated among the plurality of key switches; a mode setting section that sets a tone adjusting mode for causing the key switches to function as tone-adjusting operators for each tone to be generated by the tone generation section; and a tone adjustment section that adjusts, in the tone adjusting mode, a predetermined tone factor of the tone in response to operation of the key switch.

In the performance apparatus of the present invention, a tone can be generated, on the basis of the tone data stored in the memory in association with any one of the key switches arranged two-dimensionally, by a user operating the key switch. When the performance apparatus is placed in the tone adjusting mode by the tone adjustment section, the key switches can be caused to function as tone-factor-adjusting operators. Thus, a predetermined tone factor can be freely adjusted using the key switch.

In a preferred embodiment, any desired one of tone pitch, tone length, tone volume, tone color, etc. can be selected as the predetermined tone factor to be adjusted. Thus, where a predetermined music piece is to be performed through operation of the key switches, tone characters or characteristics, such as tone pitch, tone length, tone volume and tone color, can be adjusted with ease. At that time, characters or characteristics of tones, constituting the music piece, can be readily adjusted finely by finely setting amounts of adjustment.

As an example, the tone adjustment section adjusts the predetermined tone factor in accordance with a two-dimensional coordinate position of the operated key switch or a difference between two-dimensional coordinate positions of two or more key switches successively operated among the plurality of key switches (i.e., amount of movement of a finger of the user during operation). More specifically, the tone adjustment section adjusts the predetermined tone factor in accordance with an X- or Y-coordinate position of the operated key switch, or in accordance with a difference between X- or Y-coordinate positions of two or more key switches successively operated among the plurality of key switches.

Consider, for example, a case when different contents of adjustment are allocated to the key switches arranged in a two-dimensional matrix. For those tone factors adjustable in two directions, such as tone pitch (high and low), tone volume (great and small) and tone length (long and short), the contents of adjustment (i.e., amounts of adjustment) are set per row or column of the matrix, while, for tone color normally available in a multiplicity of types, the contents of adjustment are set per key switch. Thus, by selecting a particular key switch via which desired tone performance is obtainable, it is possible to provide an optimal and simple adjustment scheme corresponding to the item to be adjusted.

In a preferred embodiment, the performance apparatus may further comprise a plurality of light-emitting elements arranged in correspondence with two-dimensional arrangement of the plurality of key switches, and a light emission control section that controls light emission of the light-emitting elements in response to the operation of the key switch for adjusting the predetermined tone factor. For example, the tone adjustment section may adjust the predetermined tone factor in accordance with an X- or Y-coordinate position of the operated key switch or in accordance with a difference between X- or Y-coordinate positions of two or more key switches successively operated among said plurality of key switches. In this case, the light emission control section may illuminate in a line all of the light-emitting elements located at the same X- or Y-coordinate position as the operated key switch, in accordance with the X- or Y-coordinate position of the operated key switch. Thus, the user can visually confirm contents of the adjusting operation.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Now, with reference to the drawings, a description will be given about a performance apparatus in accordance with an embodiment of the present invention. This performance apparatus includes a plurality of key switches arranged in a matrix on a casing in the form of a substantially-flat rectangular parallelepiped, and it performs a music piece on the basis of selection of a desired number of the key switches. Further, this performance apparatus adjusts pitches, lengths, volumes, colors, etc. of tones to be performed in accordance with selected combinations of the key switches and control switches provided around the key switch group on the casing. Thus, the performance apparatus of the present invention can readily perform a music piece with higher elaborateness and originality and enhanced degree of freedom than the conventional performance apparatus.

Figure 1:
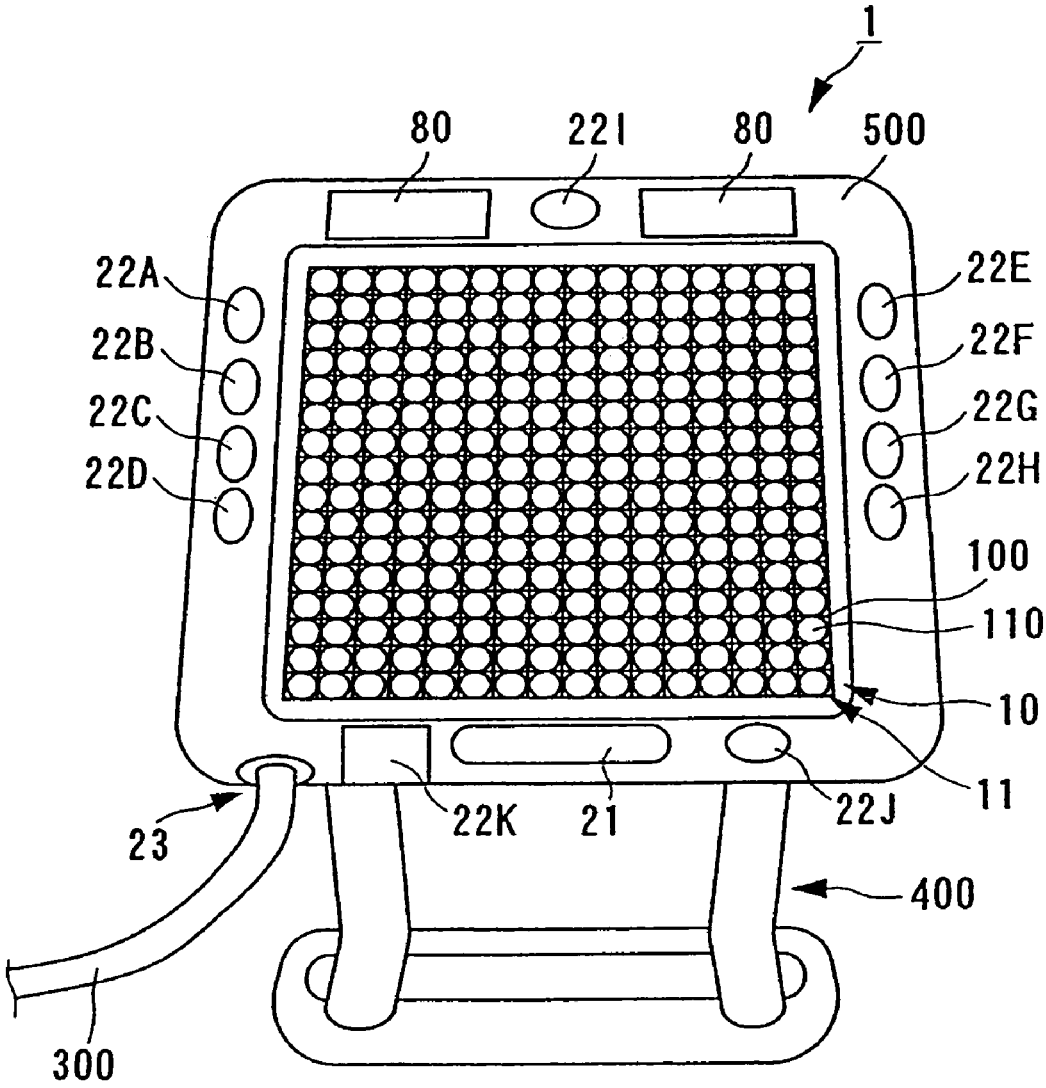
FIG. 1 is a front view of a performance apparatus in accordance with an embodiment of the present invention.
Figure 2:
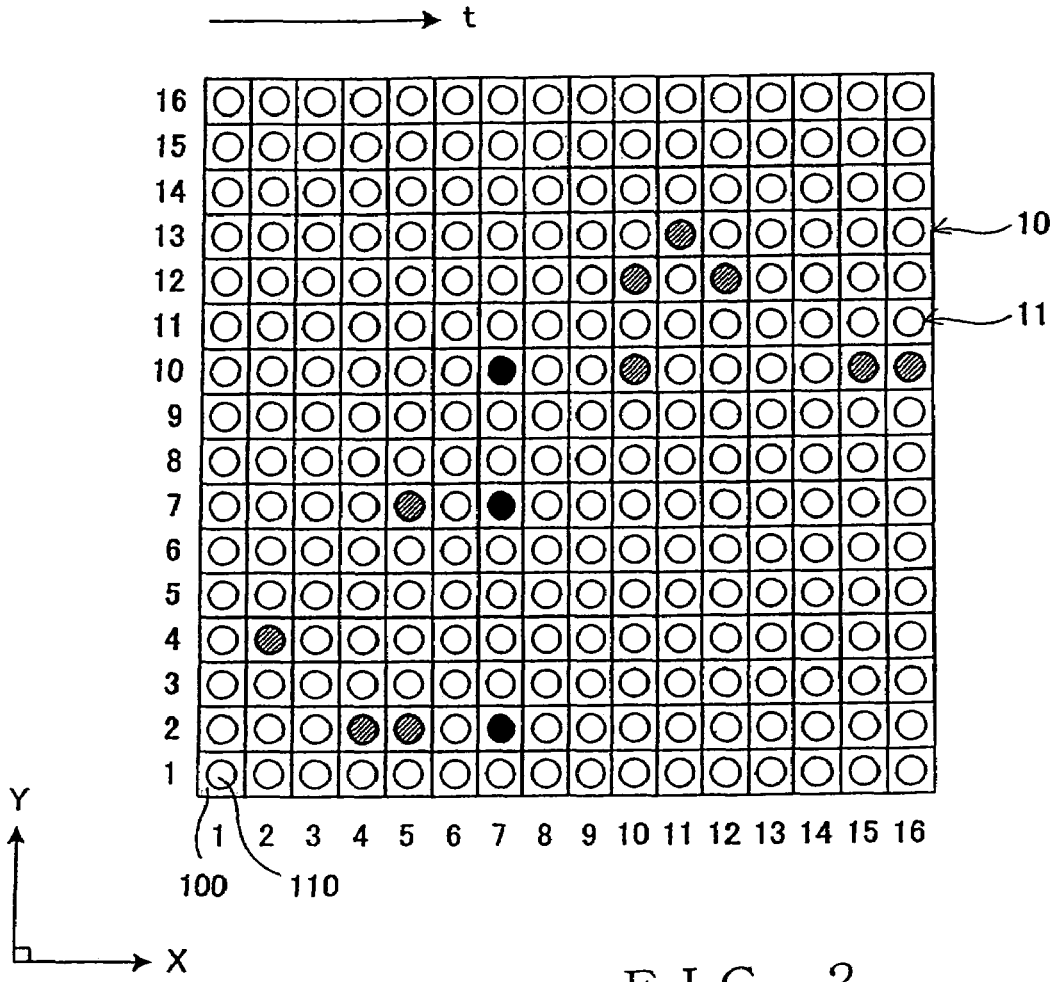
FIG. 2 is a view showing a key switch group and light-emitting display element group as viewed from the front (i.e., user side) of the performance apparatus of FIG. 1.

FIG. 1 is a front view of the performance apparatus 1 in accordance with the embodiment of the present invention. FIG. 2 is a view showing a key switch group 10 and light-emitting display elements 110 as viewed from the front (i.e., user side) of the performance apparatus 1 of FIG. 1.

The performance apparatus 1 includes the casing 500 in the form of a substantially-flat rectangular parallelepiped and is supported on a stand 400. On the upper surface of the casing 500, there are arranged key switches 100 of the key switch group 10 in a two-dimensional matrix. The key switch group 10 comprises a total of 256 key switches 100 arranged in two dimensions, with 16 key switches in each of two orthogonal (i.e., vertical and horizontal) directions of the upper surface of the casing 500.

Each of the key switches 100 is a push switch with the light-emitting display element 110, including an LED etc., built therein. All of the light-emitting display elements 110 together constitute a light-emitting display element group 11. Each of the light-emitting display elements 110 emits light in response to the user depressing a corresponding one of the key switches 100. Further, the light-emitting display element group 11 emits light in a predetermined pattern in accordance with a combination of any one of the control switches 22 (to be described later) and selected one or ones of the key switches 100.

Position of each of the key switches 100 of the key switch group 10 and each of the light-emitting display elements 110 of the light-emitting display element group 11 is indicated by two-dimensional coordinates with its position in the vertical direction as a Y-coordinate and its position in the horizontal direction as an X-coordinate. Let it be assumed here that the coordinates of the key switch 100 located at the left lower end (as the user faces) of FIG. 2 are "mtSW (1, 1)" and the coordinates of the key switch 100 located at the right upper end (as the user faces) of FIG. 2 are "mtSW (16, 16)". Let it also be assumed here that the coordinates of the light-emitting display element 110 located at the left lower end (as the user faces) of FIG. 2, corresponding to the left-rear-end key switch 100, are "mtLED (1, 1)" and the coordinates of the light-emitting display element 110 located at the right upper end (as the user faces) of FIG. 2, corresponding to the right-upper-end key switch 100, are "mtLED (16, 16)".

Control buttons 22A-22D are disposed on a left edge portion of the casing 500 located to the left (as the user faces) of the key switch group 10 and light-emitting display element group 11, while control buttons 22E-22H are disposed on a right edge portion of the casing 500 located to the right (as the user faces) of the key switch group 10 and light-emitting display element group 11. Further, a control button 22I and stereo speakers 80 are disposed on an upper edge portion of the casing 500, while control buttons 22J and 22K and a liquid crystal display section 21 are disposed on a lower edge portion of the casing 500. Further, an input terminal 23, to which is connected one end of a connecting cable 300, is provided on a lower end surface of the casing 500 adjacent to the lower edge portion. The connecting cable 300 is connected at the other hand to another performance apparatus which is a communicating party of the performance apparatus 1. Namely, the performance apparatus 1 communicates with the other performance apparatus via the connecting cable 300.

Figure 3:
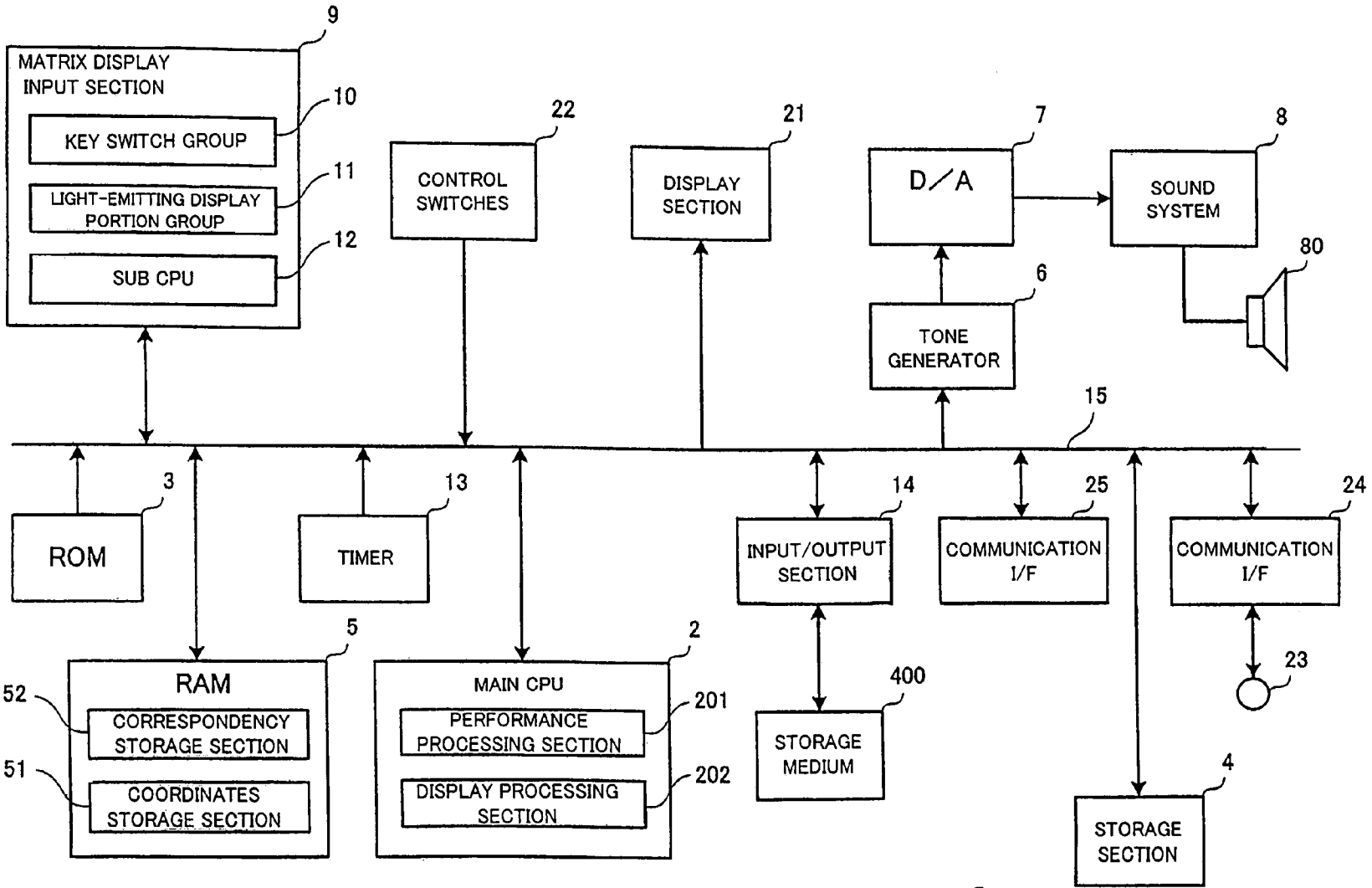
FIG. 3 is a block diagram showing an example electrical setup of the performance apparatus shown in FIG. 1.

FIG. 3 is a block diagram showing an example electrical setup of the performance apparatus 1 shown in FIG. 1.

The performance apparatus 1 includes a main CPU 2, ROM 3, storage section 4, RAM 5, tone generator 6, matrix display input section 9, display section 21, control switches 22, timer 13, input/output section 14, communication interface (I/F) 24 and communication interface (I/F) 25, which are connected with one another via a bus line 15.

The ROM 3 has prestored therein a startup program for starting up the performance apparatus 1. The storage section 4 is a rewritable data storage means, such as a flash memory or hard disk. In the storage section 4, there are prestored predetermined programs, including a performance processing program for causing the performance apparatus 1 to execute a performance, as well as predetermined data necessary for execution of the programs. The predetermined data include, for example, tone generation setting data that include data indicative of correspondency between the individual key switches 100 and tone pitches and data indicative of a reference tone color to be set by default in the tone generator 6. The tone generation setting data are preset, for example, on the basis of the MIDI standard.

The RAM 5 functions as a working area for the main CPU 2, which temporarily stores a program and data read out from the storage section 4. Further, the RAM 5 includes a coordinates storage section 51 storing data indicative of the coordinates of the key switch group 10 shown in FIG. 1, and a correspondency storage section 52.

The coordinates storage section 51 stores ON/OFF states of the individual key switches 100. The coordinates storage section 51 comprises a 16×16 table of the same arrangement and shape as the key switch group 10 shown in FIG. 2. In the coordinates storage section 51, each of the 16×16 locations corresponding to the key switches 100 is in the form of a one-bit flag. If any one of the key switches 100 has been depressed for a predetermined time length, one of the locations which corresponds to the depressed key switch 100 is set at a value "1" indicating an ON state of the key switch 100; when the location corresponding to the key switch 100 is set at a value "0", the location indicates an OFF state of the key switch 100.

The correspondency storage section 52 comprises a note number table T storing a list of note numbers to be allocated to the individual switches 100. In the note number table T employed in the instant embodiment, 16 note numbers are allocated, through initial setting, to the Y-coordinates (1-16); the same 16 note numbers are allocated to each of 16 Y-coordinate groups (or columns) corresponding to the X-coordinates (=1-16) so that the same tone pitches are selectable for each of the 16X-coordinates. Here, the "note number" is a numerical value indicative of a tone pitch or the like, which is given from a later-described performance processing section 201 to the tone generator 6; note number "60" is indicative of a center scale note "C4". In the instant embodiment, note numbers "60" to "75" are allocated to the Y-coordinates; according to the default settings on start-up of the apparatus, note number "60" is allocated to Y-coordinate "1", note number "61" to Y-coordinate "2", and so on, until note number "75" is allocated to Y-coordinate "16". Alternatively, a different note number may be allocated to each of the 16×16 (=256) switches 100. Further, the note numbers to be allocated to the switches 100 are not limited to "60"-"75".

The tone generator 6 is, for example, a MIDI tone generator (i.e., tone generator capable of generating a tone or audio waveform signal in accordance with MIDI information), which generates a digital audio (tone) signal with a predetermined tone color and passes the generated digital audio signal to the D/A converter 7. In the instant embodiment, the tone generator 6 can generate, on the basis of tone data (waveform data) stored in memory, digital audio (tone) signals of any of not only a plurality of kinds of internally-stored tone colors or internal tone colors (e.g., piano tone color, guitar tone color, etc.) but also externally-acquired desired tone colors (external tone colors). In the tone generator 6, a plurality of kinds of tone data are set, as the tone waveform data of the external tone colors, with respective note numbers assigned thereto. For example, the tone generator 6 includes a readable/writable non-volatile memory for storing external tone color data, and a plurality of kinds of tone data (waveform data) of the above-mentioned external tone colors are stored in the memory with respective predetermined note numbers assigned thereto in accordance with their tone pitch frequencies. The note numbers are associated with the key switches 100 through the above-mentioned note number table T; namely, the plurality of kinds of tone data are assigned respective note numbers in accordance with their respective pitches, so that they are associated with the key switches 100. The tone generator 6 receives, from the main CPU 2, not only tone color designation but also note number designation of a tone to be generated, to thereby read out, from the above-mentioned memory, tone data (waveform data) based on the designated tone color and tone number. Thus, the tone generator 6 generates a digital audio (tone) signal on the basis of the read-out tone data (waveform data) so that the digital audio signal is audibly reproduced or sounded for a predetermined time length (e.g., 200 msec). Note that the note number of the tone to be generated can be designated either by the user turning on a desired one of the switches 100 or on the basis of separately-stored automatic performance information. Note that the tone data (waveform data) to be stored in the memory may be in any desired compressed format other than the PCM format, such as DPCM or ADPCM format.

The D/A converter 7 converts the digital audio signal, received from the tone generator 6, into an analog audio signal and supplies the analog audio signal to the sound system 8. The sound system 8 audibly reproduces or sounds the supplied analog audio signal through the speakers 80.

The matrix display input section 9 comprises the key switch group 10 and light-emitting display element group 11 described above in relation to FIG. 1, and a sub CPU 12.

The sub CPU 12 detects the coordinates of each depressed key switch 100 (FIG. 2) and supplies the detected coordinates to the main CPU 2 as depressed key switch position information.

The timer 13 counts time to inform the main CPU 2 of the counted time. The input/output section 14 is an interface circuit for inputting/outputting data from/to a storage medium 400, The control switches 22 are operable by the user to give various control instructions for adjusting tone characters or characteristics or tone factors of each tone data, such as tone pitch, length, volume and color; in other words, the control switches 22 constitute a mode setting section for setting a tone adjusting mode. Desired characteristic of each tone data, such as a tone pitch, can be adjusted (i.e., the tone adjusting mode can be set) by a predetermined one of the key switches 100 of the group 10 being depressed (or selected) with a predetermined one of the control switches 22 kept in a depressed state.

The main CPU 2, which controls operation of each component connected thereto, executes a performance program so as to function as a performance processing section 201 and display processing section 202.

The performance processing section 201 uses the tone generation setting data stored in the storage section 4 to control the audio signal generation by the tone generator 6 so that a tone, corresponding to each of the key switches 100 operated by the user, is generated. More specifically, as an initialization operation, the performance processing section 201 designates a predetermined initial tone color to the tone generator 6 and registers, by the above-mentioned initial setting, the note numbers, corresponding to the Y-coordinates of the individual key switches 100, into the note number table T.

The performance processing section 201 receives depressed key switch position information from the sub CPU 12 to detect the coordinates of a user-depressed key switch 100.

The performance processing section 201 refers to the note number table T to identify the note number corresponding to the detected coordinates and inform the tone generator 6 of the identified note number. Thus, the tone generator 6 generates a reference audio signal, corresponding to the key switch 100 depressed by the user, with the currently-set tone color. In this way, the user can execute performance operation using the key switch group 10 like a keyboard.

When any one of the key switches 100 has been depressed for a predetermined time length, the performance processing section 201 sets, i.e. turns ON, the flag at the storage location of the coordinates storage section 51 corresponding to the depressed key switch 100. The ON state of the location is canceled, i.e. the set flag is reset, by the performance processing section 201 in response to the ON-state switch 100 being kept depressed for a long time. Then, once the performance processing section 201 receives an automatic-performance-setting selecting instruction which has been given by the user depressing an automatic performance control switch among the control switches 22, it carries out automatic performance processing. In the automatic performance processing, the performance processing section 201 repetitively moves a to-be-sounded row pointer P from the left end to the right on the coordinate storage section 51. The performance processing section 20 instructs the tone generator 6 to generate a tone only for a time when the to-be-sounded row pointer P and the storage location of each of the key switches 100 in the ON state are overlapping each other. Thus, in the automatic performance processing, tone pitches are expressed on the Y axis while tone generation timing (tone length) is expressed on the X axis, so that the performance apparatus 1 is allowed to compose and execute a music performance with ease. Note that the "to-be-sounded row pointer" P is a pointer for instructing tone generation of a note, for which the flag is at the value "1", of all of the notes on the Y-axis coordinates (i.e. all of the notes in a vertical row or column) corresponding to a specific X-axis coordinate location in the coordinate storage section 51. With the X coordinate location, indicated by the to-be-sounded row pointer P, sequentially varying from "1" to "16" in a repeated fashion, an automatic performance of notes programmed at tone generation timing "1" to "16" is carried out repeatedly.

Further, when an instruction for changing settings of a characteristic of a tone ("tone generator setting change instruction") has been given by the user depressing a predetermined combination of any one of the control switches 22 and any of the key switches 100, the performance processing section 201 performs processing (tone generator setting change processing) for changing settings of the tone pitch, length, volume or color to be set in the tone generator 6. In the case where the tone color to be set in the tone generator 6 should be changed, the tone color can be changed either to an internal tone color or to an external tone color.

The display processing section 202 performs display processing for controlling the light-emitting display of the light-emitting display element group 11. In the display processing, the display processing section 202 illuminates one of the light-emitting display elements 11, corresponding to a depressed or selected key switch 100, as long as the tone is sounded (i.e., for the same time length as the sounding of the tone). More specifically, when the key switch 100 has been depressed for only a short time, the display processing section 202 illuminates the corresponding light-emitting display element 110 with a high light intensity in accordance with the key depression time. On the other hand, when the key switch 100 has been turned ON by being depressed for a long time, the display processing section 202 illuminates the corresponding light-emitting display element 110 with a low light intensity until the depression of the key switch is released. Further, when the to-be-sounded row pointer P and the coordinates of the key switches 100 in the ON state have overlapped as indicated at mtLED (7, 10), mtLED (7, 7) and mtLED (7, 2) in FIG. 2, the display processing section 202 illuminates the corresponding light-emitting display elements 110 with the high light intensity as long as the overlapping lasts, after which it returns the display elements 110 to illumination with the low light intensity.

Further, once one of the key switches 100 is depressed with the control switch 22 still kept depressed, the display processing section 202 illuminates the light-emitting display element group 11 in a preset illumination pattern. For example, in processing for adjusting a tone pitch, length or volume, as will be later described in detail, the light-emitting display elements of a horizontal key switch row which a depressed or selected key switch 100 belongs to (more specifically, if the depressed key is of coordinates (m, n), a horizontal key switch row comprising key switches (1, n)-(16, n)) are illuminated in a line shape. Further, in processing for adjusting a tone color, the light-emitting display elements of vertical and horizontal key switch rows which a depressed or selected key switch 100 belongs to are illuminated in a cross-shape.

Referring back to FIG. 3, the communication I/F 24 and communication I/O 25 are connected via the bus 15 to the main CPU 2. The communication I/F 24 is an interface circuit intended for communication with other equipment connected to the performance apparatus 1 via the input terminal 23 and connecting cable 300 shown in FIG. 1. The communication I/O 25, on the other hand, is an interface circuit intended for communication via a not-shown wide area network, such as the Internet, or LAN.

The following paragraphs describe processing performed in the performance apparatus in accordance with the embodiment of the invention.

Figure 4:
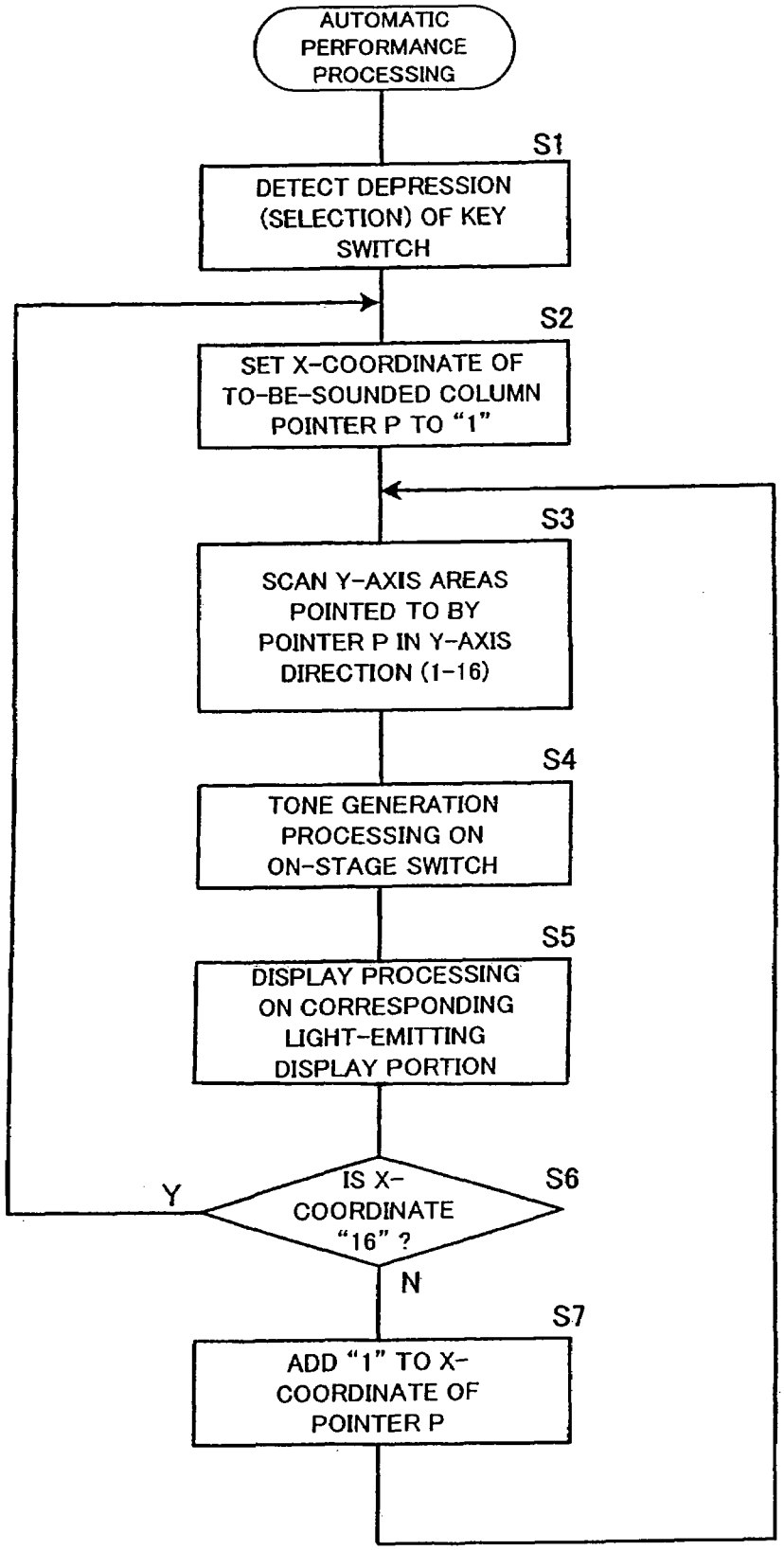
FIG. 4 is a flow chart of automatic performance processing performed in the embodiment of the performance apparatus.

FIG. 4 is a flow chart of the automatic performance processing performed in the performance apparatus in accordance with the embodiment of the invention. If any one of the key switches 100 has been kept depressed by the user for the predetermined time length, the sub CPU 12 of the matrix display input section 9 sets the depressed key switch 100 to a selected state and supplies coordinates information of this selected key switch 100 to the main CPU 2. Simultaneously, the sub CPU 12 illuminates one of the light-emitting display elements 110, corresponding to the selected key switch 100, with the low light intensity (step S1).

Figure 5:
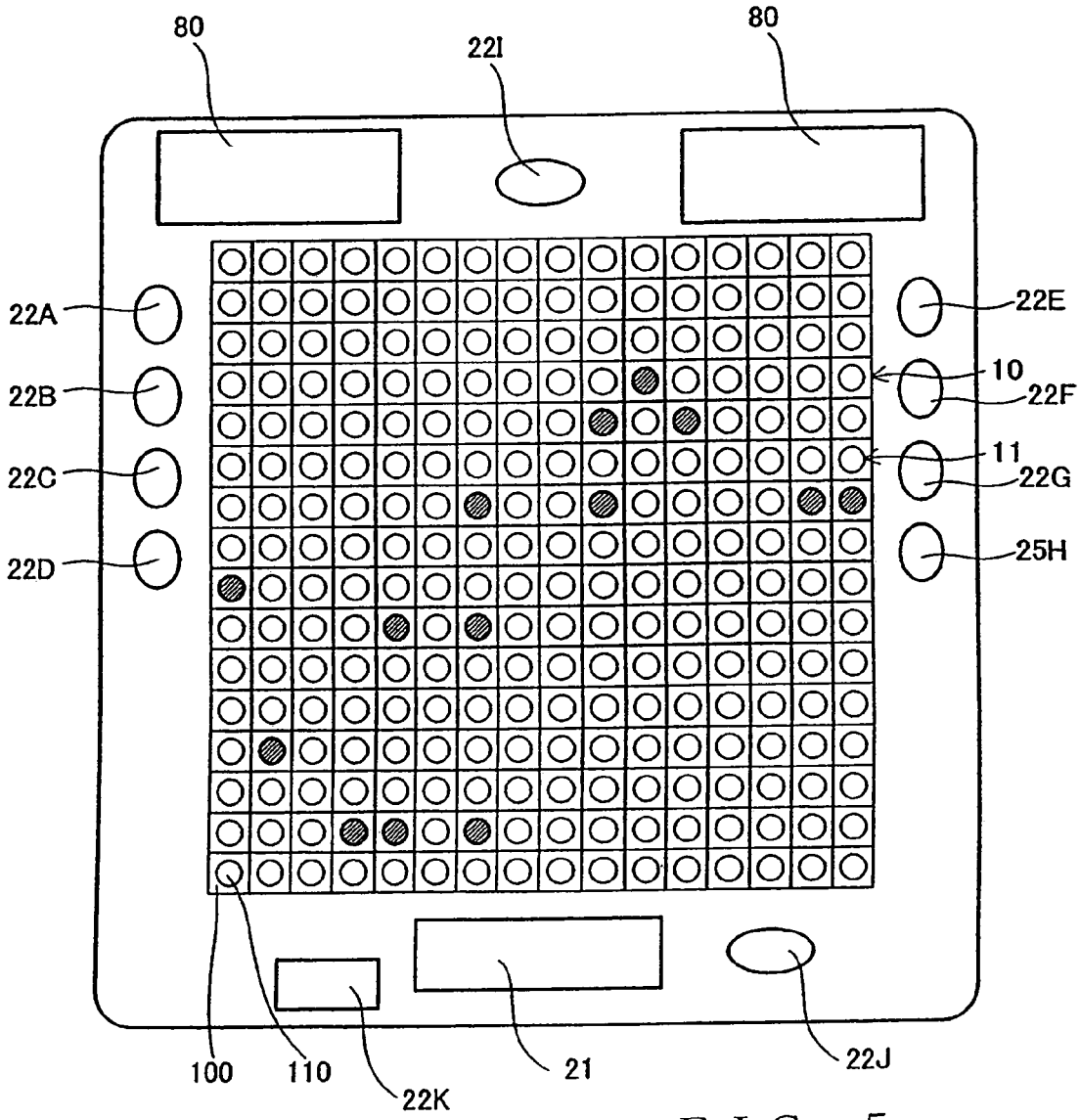
FIG. 5 is a front view of a matrix display section when a predetermined one of the key switches is in a selected state.

FIG. 5 is a front view of the matrix display input section 9 when some of the key switches 100 are in the selected state; in FIG. 5, the light-emitting display elements 110 illuminated with the low light intensity are indicated by hatched circles.

Next, the performance processing section 201 of the main COU 2 positions the to-be-sounded row pointer P in the area of the X-coordinate "1" on the coordinate storage section 51, at step S2. Next, the performance processing section 201 scans the entire Y-axis area (i.e., vertical row or column) corresponding to the X-coordinate area pointed to by the to-be-sounded row pointer P, to detect any key switch 100 currently in the ON state in the pointer-indicated area (step S3). If the to-be-sounded row pointer P is positioned in the area corresponding to the X-coordinate "1", the performance processing section 201 scans from "mtSW(1, 1)" to "mtSW (1, 16)".

Figure 6:
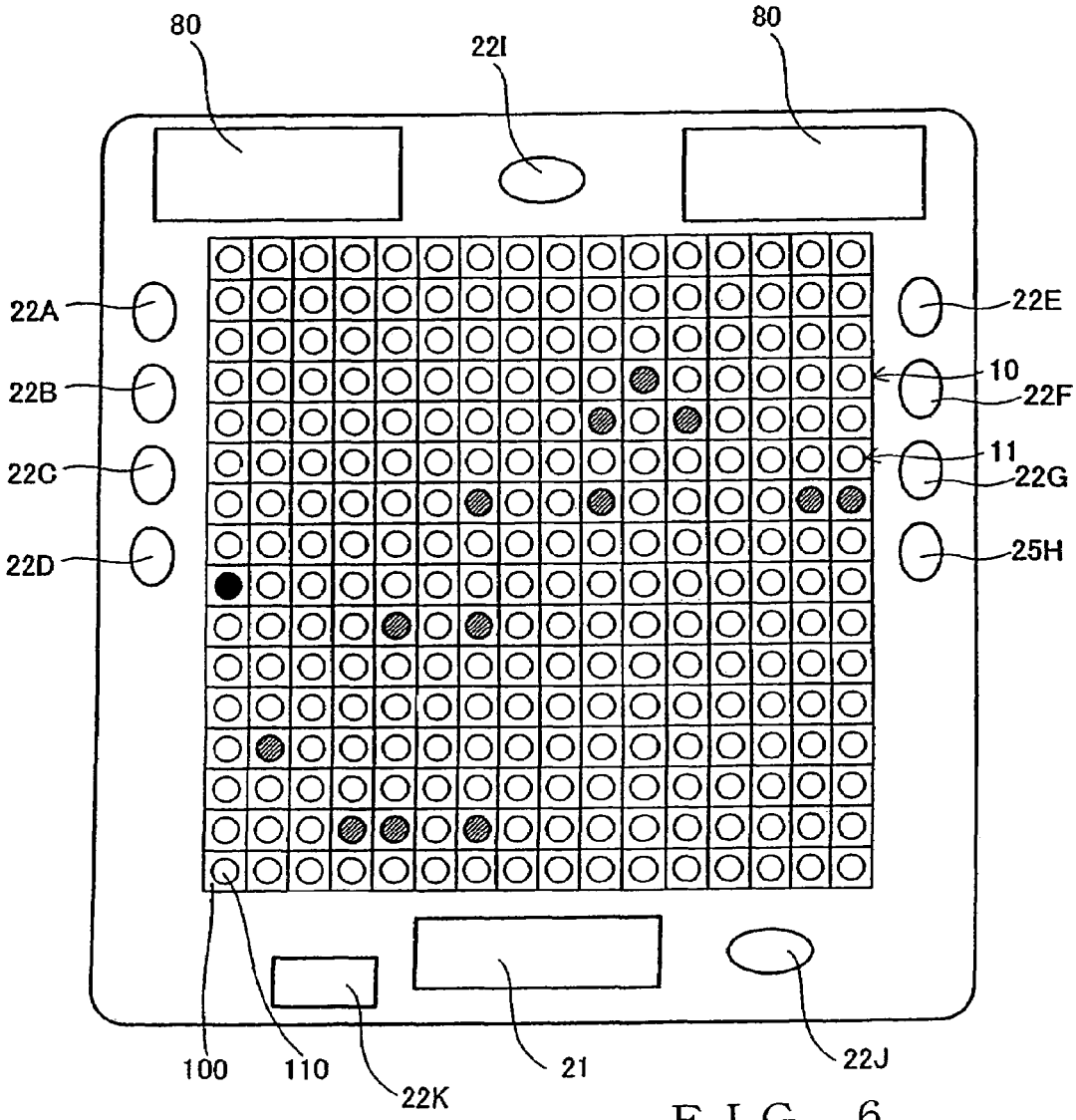
FIG. 6 is a front view of the matrix display input section when the selected key switch and a to-be-sounded row pointer has overlapped with each other.

Once any key switch 100 currently in the ON state and the to-be-sounded row pointer P overlap with each other, the performance processing section 201 carries out tone generation processing on the ON-state key switch 100 for a preset tone length (step S4). Simultaneously, the performance processing section 201 causes the display processing section 202 to perform display processing to illuminate one of the light-emitting display elements 110, corresponding to the ON-state key switch 100, with the low light intensity for a predetermined time length (corresponding to the tone length), as seen in FIG. 6 and then returns the light-emitting display element 110 to the illumination with the low light intensity (step S5). FIG. 6 is a front view of the matrix display input section 9 when the selected key switch 100 and the to-be-sounded row pointer P has overlapped with each other, in which each the light-emitting display element 110 illuminated with the low light intensity is indicated by a hatched circle and each light-emitting display element 110 illuminated with the high light intensity is indicated by a painted-in-black circle.

Here, the "tone length" (predetermined time length) corresponds to a time length over which the to-be-sounded row pointer P and the X-coordinate of the key switch 100 are overlapping with each other. Thus, the corresponding light-emitting display element 110 is illuminated with the high light intensity for the time length over which the to-be-sounded row pointer P and the X-coordinate of the key switch 100 are overlapping with each other.

Then, the performance processing section 201 makes a determination, at step S6, as to whether the area currently pointed to by the to-be-sounded row pointer P is of the rightmost X-coordinate ("16" in this case). If the area currently pointed to by the to-be-sounded row pointer P is of the rightmost X-coordinate as determined at step S6 (YES determination at step S6), the performance processing section 201 reverts to step S2, while, if the area currently pointed to by the to-be-sounded row pointer P is not of the rightmost X-coordinate (NO determination at step S6), the performance processing section 201 adds "1" to the X-coordinate corresponding to the area currently pointed to by the to-be-sounded row pointer P, namely, moves the pointer P to the next area (i.e., area located immediately to the right of the area so far pointed to by the pointer P), at step S7. After that, the performance processing section 201 reverts to step S3.

In such processing, the tone pitch, length and volume are set at prestored reference values. The tone color too is set at a prestored reference tone color.

Thus, the instant embodiment of the performance apparatus 1 is constructed to adjust the tone pitch, length, volume and color in the following manner.

Different control commands are allocated in advance to the control switches 22 provided on the casing 500. For example, tone color adjustment control is allocated to the control switch 22A, tone pitch adjustment control is allocated to the control switch 22B, tone length adjustment control is allocated to the control switch 22C, and tone volume adjustment control is allocated to the control switch 22D.

Figure 7:
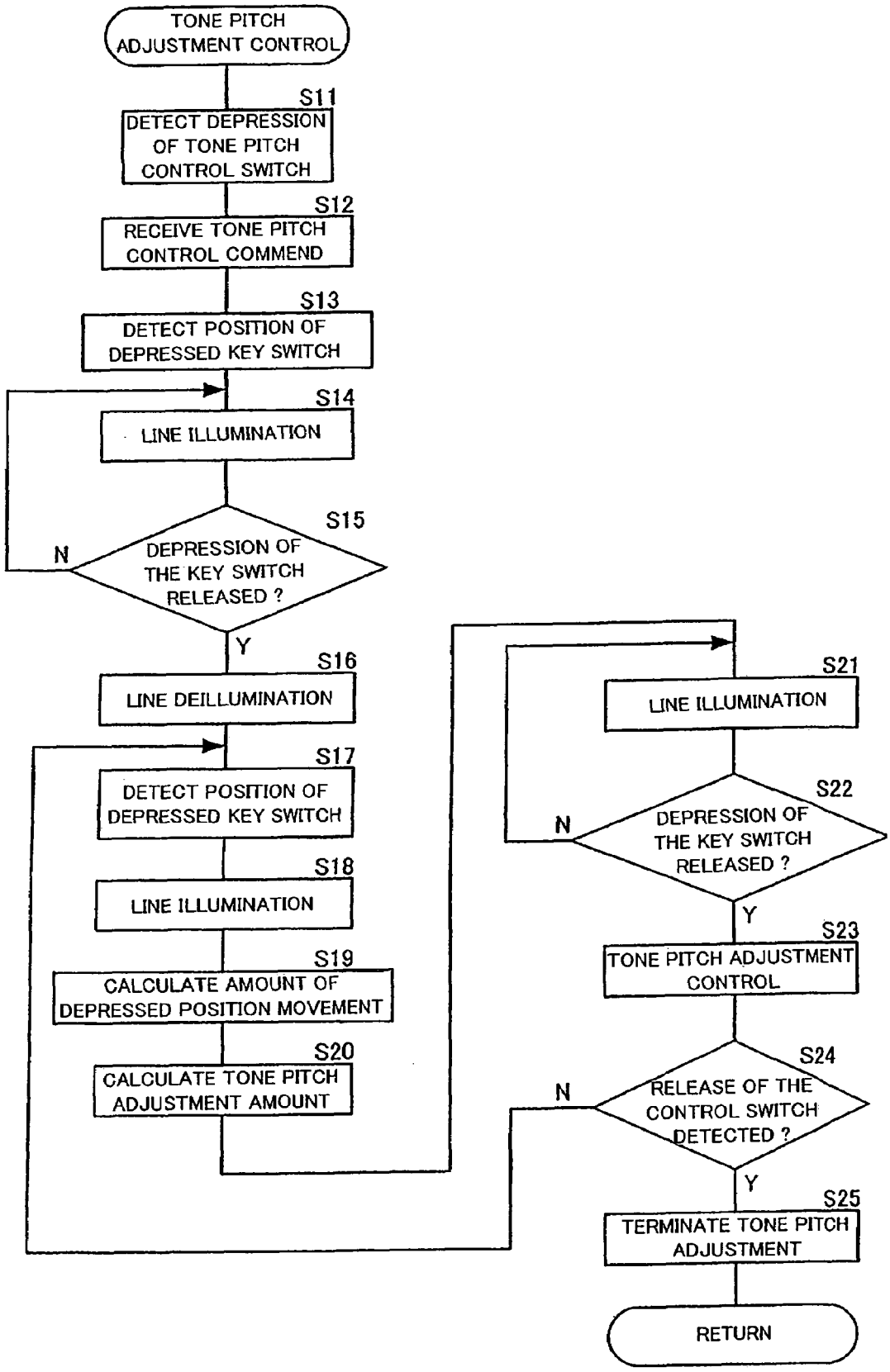
FIG. 7 is a flow chart of tone pitch adjustment control performed in the embodiment of the performance apparatus.
Figure 8A:
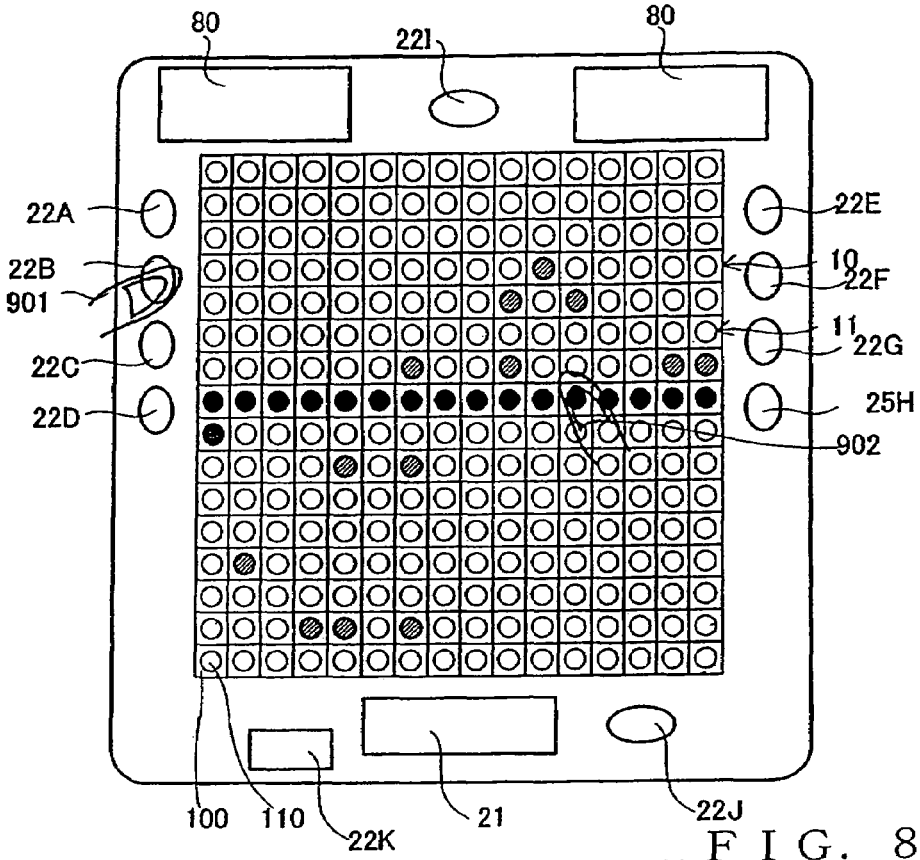
FIGS. 8A and 8B are front views of the performance apparatus at initial and subsequent stages of the tone pitch adjustment.
Figure 8B:
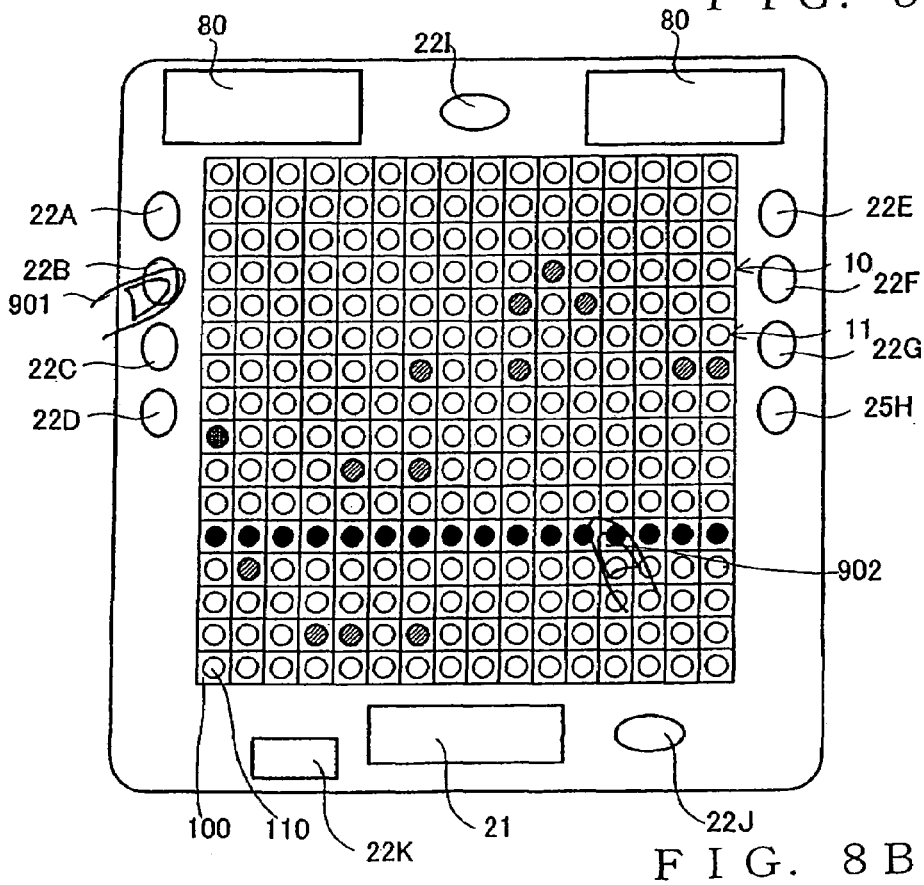

(1) Tone Pitch Adjustment:

FIG. 7 is a flow chart of tone pitch adjustment control performed in the performance apparatus 1. FIG. 8A is a front view of the performance apparatus 1 at an initial stage of the tone pitch adjustment, and FIG. 8B is a front view of the performance apparatus 1 at a subsequent stage (following the initial stage) of the tone pitch adjustment.

In order to perform desired tone pitch adjustment, the user depresses the tone pitch control switch 22B with a finger 901. The main CPU 2 detects the depression of the tone pitch control switch 22B at step S11, and it receives a tone pitch control command and performs tone pitch adjustment control processing on the display input section 9 (step S12).

Then, the user depresses one of the key switches 100 of the matrix display section 9 with another finger 902 while still depressing the tone pitch control switch 22B with the finger 901. The sub CPU 12 detects the position of the depressed key switch 100 (step S13), gives the identified coordinates (only the Y-coordinate suffices) to the main CPU 2, and illuminates, with the high light intensity, all of the light-emitting display elements 110 of the horizontal row which the depressed key switch 100 belongs to ("high-intensity line illumination") (step S14). In the illustrated example of FIG. 8A, all of the light-emitting display elements 110 of the horizontal row (i.e., mtLED(X, 9)) which the key switch mtSW(12, 9) belongs to are illuminated with the high light intensity.

Then, once the depression of the key switch 100 is released by the user moving the finger 902 on the matrix display input section 9 (step S15), the high-light-intensity illumination of the horizontal row which the depressed key switch 100 belongs to is terminated (i.e., line deillumination)(S16). Then, when the user has depressed one of the key switches 100 in another horizontal row, the sub CPU 12 detects the position of the depressed key switch 100 (step S17), gives the identified coordinates (only the Y-coordinate suffices) to the main CPU 2, and illuminates, with the high light intensity, all of the light-emitting display elements 110 of the horizontal row which the depressed key switch 100 belongs to ("high-intensity illumination line") (step S18). In the illustrated example of FIG. 8B, all of the light-emitting display elements 110 of the horizontal row (i.e., mtLED(X, 5)) which the key switch mtSW(13, 5) are illuminated with the high light intensity.

The main CPU 2 calculates an amount of depressed position movement in the Y-axis direction on the basis of the Y-coordinates of the key switch 100 selected before the depressed position movement and the Y-coordinates of the key switch 100 selected after the depressed position movement, i.e. a difference between Y-coordinate portions before and after the depressed position movement (step S19). The "amount of depressed position movement" corresponds to an amount of finger movement effected for depressing one key switch after another. In the storage section 4, RAM 5 or the like, relationship between amounts of depressed position movement and tone pitch adjustment is prestored. For example, if the depressed position has been moved downward in the vertical (Y-coordinate) direction, the tone pitch is lowered in accordance with an amount of the vertical depressed position movement, while, if the depressed position has been moved upward in the vertical direction, the tone pitch is raised in accordance with an amount of the vertical depressed position movement. The performance processing section 201 of the main CPU 2 reads out an amount of tone pitch adjustment corresponding to the calculated amount of depressed position movement (step S20) and performs tone pitch adjustment control on the tone generator 6 (step S23).

During such processing, the high-light-intensity illumination of the horizontal row which the depressed key switch 100 belongs to is terminated (S21) once the current depression of the key switch 100 has been released (step S22) by the user further moving the finger 902 on the matrix display input section 9.

Such tone pitch adjustment processing based on depressed position movement between the key switches 100 is repeated until the main CPU 2 detects termination of the depression of the tone pitch control switch 22B (step S24→S17). Upon detection of the termination of the depression of the tone pitch control switch 22B (step S24), the main CPU 2 terminates the tone pitch adjustment control (step S25).

With such processing, the user is allowed to readily adjust the tone pitch relative to the preset reference tone and thereby perform a music piece with an enhanced degree of freedom. Further, because the tone pitch adjustment amount can be visually recognized through movement of the illumination line, the user is allowed to clearly recognize the tone pitch adjustment amount.

Figure 9:
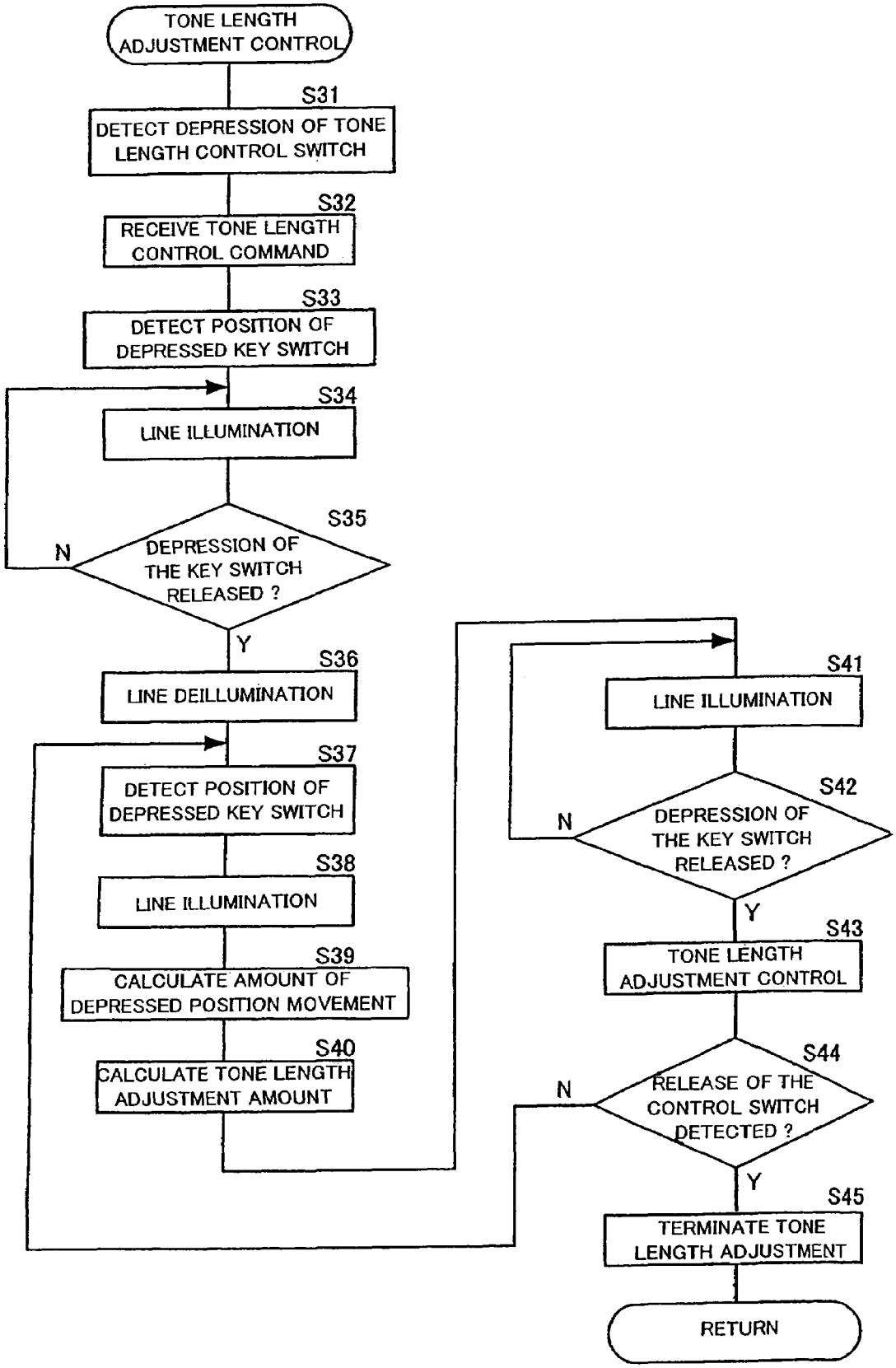
FIG. 9 is a flow chart of tone length adjustment control performed in the embodiment of the performance apparatus.
Figure 10A:
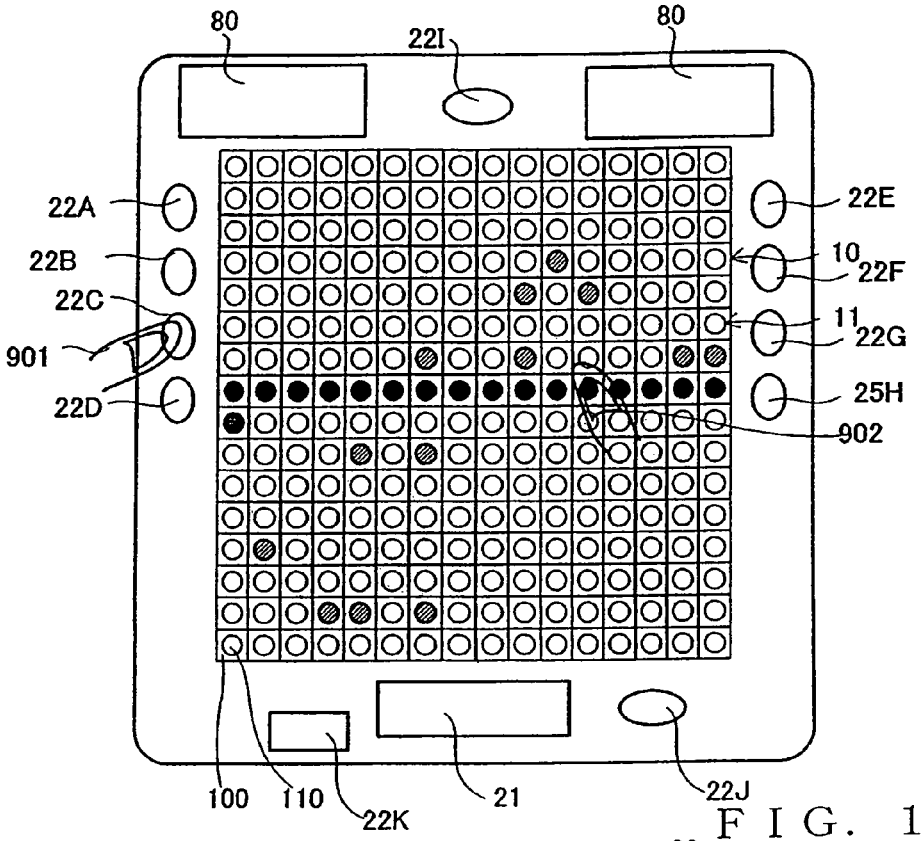
FIGS. 10A and 10B are front views of the performance apparatus at initial and subsequent stages of the tone length adjustment.
Figure 10B:
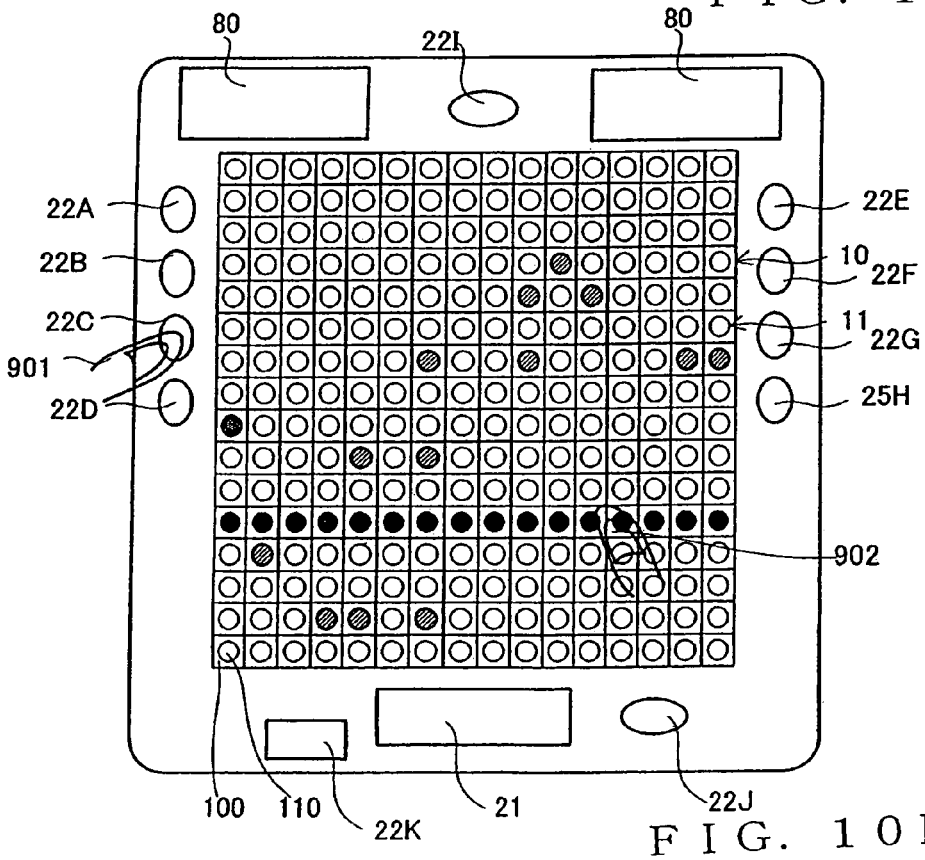

(2) Tone Length Adjustment:

FIG. 9 is a flow chart of tone length adjustment control performed in the performance apparatus 1. FIG. 10A is a front view of the performance apparatus 1 at an initial stage of the tone length adjustment, and FIG. 10B is a front view of the performance apparatus 1 at a subsequent stage (following the initial stage) of the tone length adjustment.

In order to perform desired tone length adjustment, the user depresses the tone length control switch 22C with a finger 901. The main CPU 2 detects the depression of the tone length control switch 22C at step S31, and it receives a tone length control command and then performs tone length adjustment control processing on the display input section 9 (step S32).

Then, the user depresses one of the key switches 100 of the matrix display section 9 with another finger 902 while still depressing the tone length control switch 22C with the finger 901. The sub CPU 12 detects the position of the depressed key switch 100 (step S33), gives the identified coordinates (only the Y-coordinate suffices) to the main CPU 2, and illuminates, with the high light intensity, all of the light-emitting display elements 110 of the horizontal row which the depressed key switch 100 belongs to ("high-intensity illumination line") (step S34). In the illustrated example of FIG. 10A, all of the light-emitting display elements 110 of the horizontal row (i.e., mtLED(X, 9)) which the key switch mtSW(12, 9) belongs to are illuminated with the high light intensity.

Then, once the depression of the key switch 100 is released by the user moving the finger 902 on the matrix display input section 9 (step S35), the high-light-intensity illumination of the horizontal row which the depressed key switch 100 belongs to is terminated (S36). Then, when the user has depressed one of the key switches 100 of another horizontal row, the sub CPU 12 detects the position of the depressed key switch 100 (step S37), gives the identified coordinates (only the Y-coordinate suffices) to the main CPU 2, and illuminates, with the high light intensity, all of the light-emitting display elements 110 of the horizontal row which the depressed key switch 100 belongs to ("high-intensity illumination line") (step S38). In the illustrated example of FIG. 10B, all of the light-emitting display elements 110 of the horizontal row (i.e., mtLED(X, 5)) which the key switch mtSW(13, 5) belongs to are illuminated with the high light intensity.

The main CPU 2 calculates an amount of depressed position movement in the Y-axis direction on the basis of the Y-coordinates of the key switch 100 selected before the depressed position movement and the Y-coordinates of the key switch 100 selected after the depressed position movement (step S39). In the storage section 4, RAM 5 or the like, relationship between amounts of depressed position movement and tone length adjustment is prestored. For example, if the depressed position has been moved upward in the vertical (Y-coordinate) direction, the tone length is increased in accordance with an amount of the vertical depressed position movement, while, if the depressed position has been moved downward in the vertical direction, the tone length is reduced in accordance with an amount of the vertical depressed position movement. The performance processing section 201 of the main CPU 2 reads out an amount of tone length adjustment corresponding to the calculated amount of depressed position movement (step S40) and performs tone length control on the tone generator 6 (step S43).

During such processing, the high-light-intensity illumination of the horizontal row which the depressed key switch 100 belongs to is terminated (S41) once the current depression of the key switch 100 has been released (step S42) by the user further moving the finger 902 on the matrix display input section 9.

Such tone length adjustment processing based on depressed position movement between the key switches 100 is repeated until the main CPU 2 detects termination of the depression of the tone length switch 22C (step S44→S37). Upon detection of the termination of the depression of the tone length control switch 22C (step S44), the main CPU 2 terminates the tone length adjustment control (step S45).

With such processing, the user is allowed to readily adjust the tone length relative to the preset reference tone and thereby perform a music piece with an enhanced degree of freedom. Further, because the tone length adjustment amount can be visually recognized through movement of the illumination line, the user is allowed to clearly recognize the tone length adjustment amount.

Figure 11:
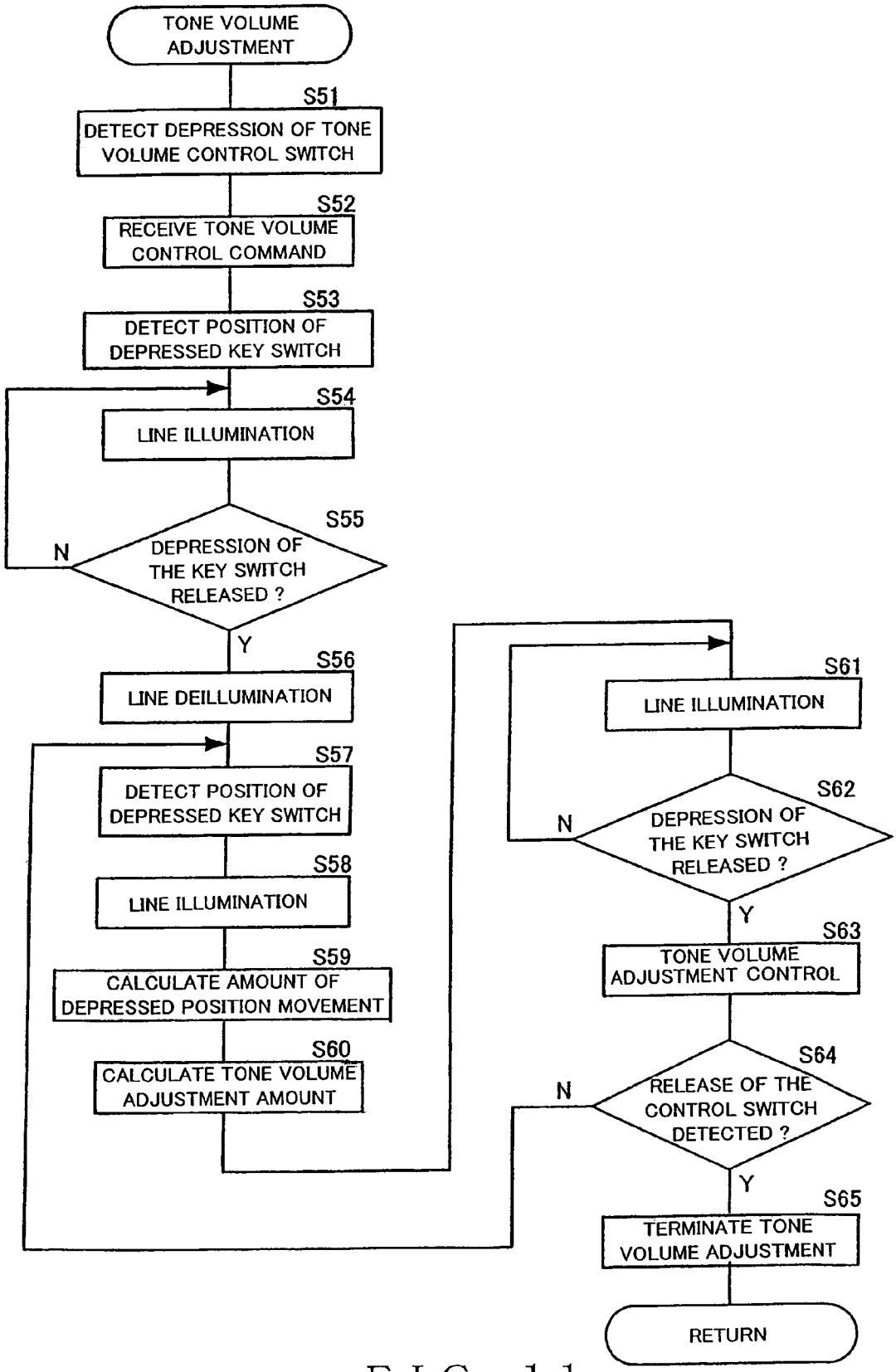
FIG. 11 is a flow chart of tone volume adjustment control performed in the embodiment of the performance apparatus.
Figure 12A:
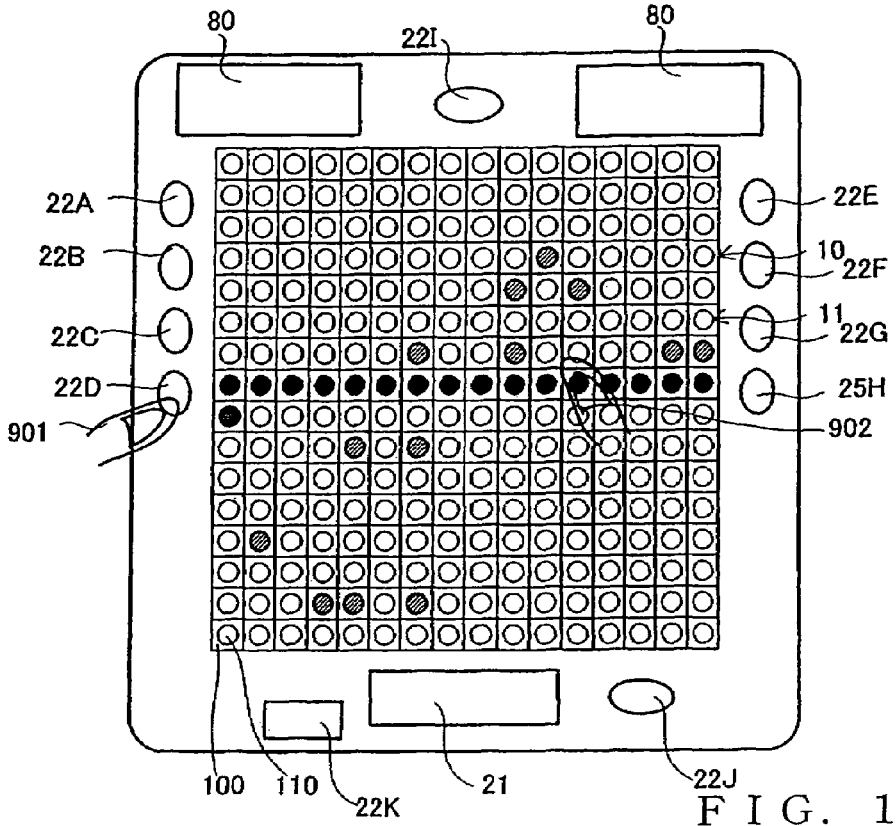
FIGS. 12A and 12B are front views of the performance apparatus at initial and subsequent stages of the tone volume adjustment.
Figure 12B:
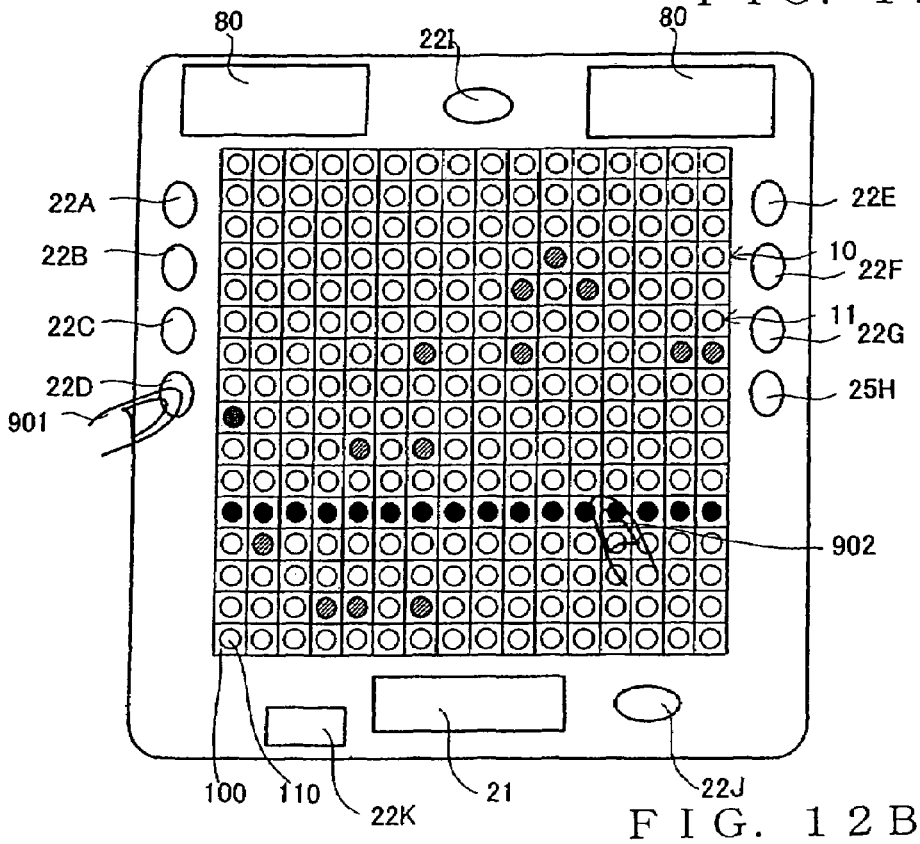

(3) Tone Volume Adjustment:

FIG. 11 is a flow chart of tone volume adjustment control performed in the performance apparatus 1. FIG. 12A is a front view of the performance apparatus 1 at an initial stage of the tone volume adjustment, and FIG. 12B is a front view of the performance apparatus 1 at a subsequent stage (following the initial stage) of the tone volume adjustment.

In order to perform desired tone volume adjustment, the user depresses the tone volume control switch 22D with a finger 901. The main CPU 2 detects the depression of the tone volume control switch 22D at step S51, and it receives a tone volume control command and then performs tone volume adjustment control processing on the display input section 9 (step S52).

Then, the user depresses one of the key switches 100 of the matrix display section 9 with another finger 902 while still depressing the tone volume control switch 22D with the finger 901. The sub CPU 12 detects the position of the depressed key switch 100 (step S53), gives the identified coordinates (only the Y-coordinate suffices) to the main CPU 2, and illuminates, with the high light intensity, all of the light-emitting display elements 110 of the horizontal row which the depressed key switch 100 belongs to ("high-intensity illumination line") (step S54). In the illustrated example of FIG. 12A, all of the light-emitting display elements 110 of the horizontal row (i.e., mtLED(X, 9)) which the key switch mtSW(12, 9) belongs to are illuminated with the high light intensity.

Then, once the depression of the key switch 100 is released by the user moving the finger 902 on the matrix display input section 9 (step S55), the high-light-intensity illumination of the horizontal row which the depressed key switch 100 belongs to is terminated (S56). Then, when the user has depressed one of the key switches 100 in another horizontal row, the sub CPU 12 detects the position of the depressed key switch 100 (step S57), gives the identified coordinates (only the Y-coordinate suffices) to the main CPU 2, and illuminates, with the high light intensity, all of the light-emitting display elements 110 of the horizontal row which the depressed key switch 100 belongs to ("high-intensity illumination line") (step S58). In the illustrated example of FIG. 12B, all of the light-emitting display elements 110 of the horizontal row (i.e., mtLED(X, 5)) which the key switch mtSW(13, 5) belongs to are illuminated with the high light intensity.

The main CPU 2 calculates an amount of depressed position movement in the Y-axis direction on the basis of the Y-coordinates of the key switch 100 selected before the depressed position movement and the Y-coordinates of the key switch 100 selected after the depressed position movement (step S59). In the storage section 4, RAM 5 or the like, relationship between amounts of depressed position movement and tone volume adjustment is prestored. For example, if the depressed position has been moved downward in the vertical (Y-coordinate) direction, the tone volume is reduced in accordance with an amount of the vertical depressed position movement, while, if the depressed position has been moved upward in the vertical direction, the tone volume is increased in accordance with an amount of the vertical depressed position movement. The performance processing section 201 of the main CPU 2 reads out an amount of tone volume adjustment corresponding to the calculated amount of depressed position movement (step S60) and performs tone volume control on the tone generator 6 (step S63).

During such processing, the high-light-intensity illumination of the horizontal row which the depressed key switch 100 belongs to is terminated (S61) once the current depression of the key switch 100 has been released (step S62) by the user further moving the finger 902 on the matrix display input section 9.

Such tone volume adjustment processing based on depressed position movement between the key switches 100 is repeated until the main CPU 2 detects termination of the depression of the tone volume switch 22D (step S64→S57). Upon detection of the termination of the depression of the tone volume control switch 22D (step S64), the main CPU 2 terminates the tone volume adjustment control (step S65).

With such processing, the user is allowed to readily adjust the tone volume relative to the preset reference tone and thereby perform a music piece with an enhanced degree of freedom. Further, because the tone volume adjustment amount can be visually recognized through movement of the illumination line, the user is allowed to clearly recognize the tone volume adjustment amount. If the performance apparatus 1 is provided with a volume control, finer tone volume adjustment is permitted by setting a width of the tone volume adjustment, attained by a combination of the tone volume control switch 22D and key switch 100, to be smaller than a width of the tone volume adjustment attained by the volume control.

If the user smoothly moves his or her finger in the above-described tone pitch, tone length, tone volume control, the adjustment amount and high-intensity illumination line are allowed to vary gradually in accordance the above-described processing flows.

Further, the embodiment has been described above in relation to the case where a desired one of the control switches is depressed by the user and the characteristic of a tone at the time point of depression of a desired one of the key switches is set as a center of adjustment and an amount of adjustment is obtained from an amount of depressed position movement; the embodiment has been described above in relation to an inventive method for changing relative adjustment amounts. However, in an alternative, specific characteristics of a tone, such as preset absolute tone pitches, preset absolute tone lengths and preset absolute tone volumes, may be set to the individual lines of the light-emitting display elements, so that a characteristic of a tone may be set on the basis of a position of the line which a user-depressed key switch belongs to are illuminated with the high light intensity.

Figure 13:
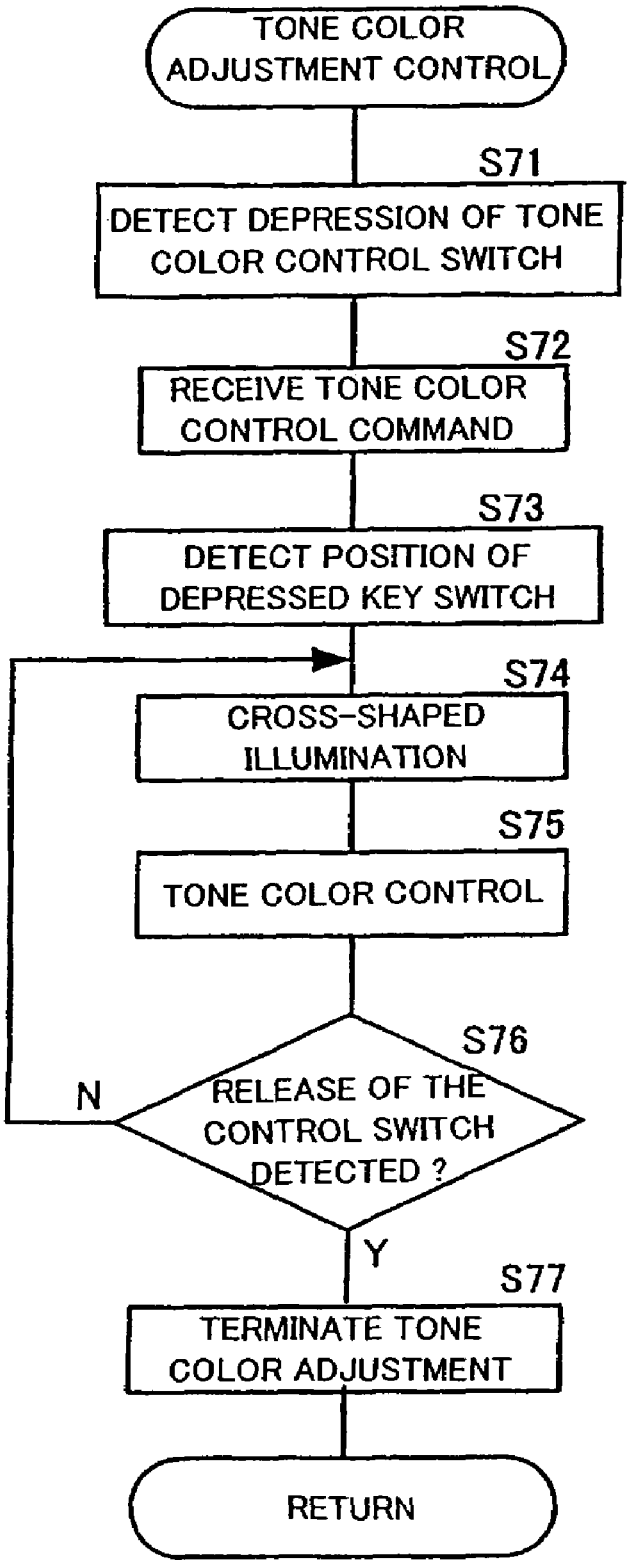
FIG. 13 is a flow chart of tone color adjustment control performed in the embodiment of the performance apparatus.
Figure 14A:
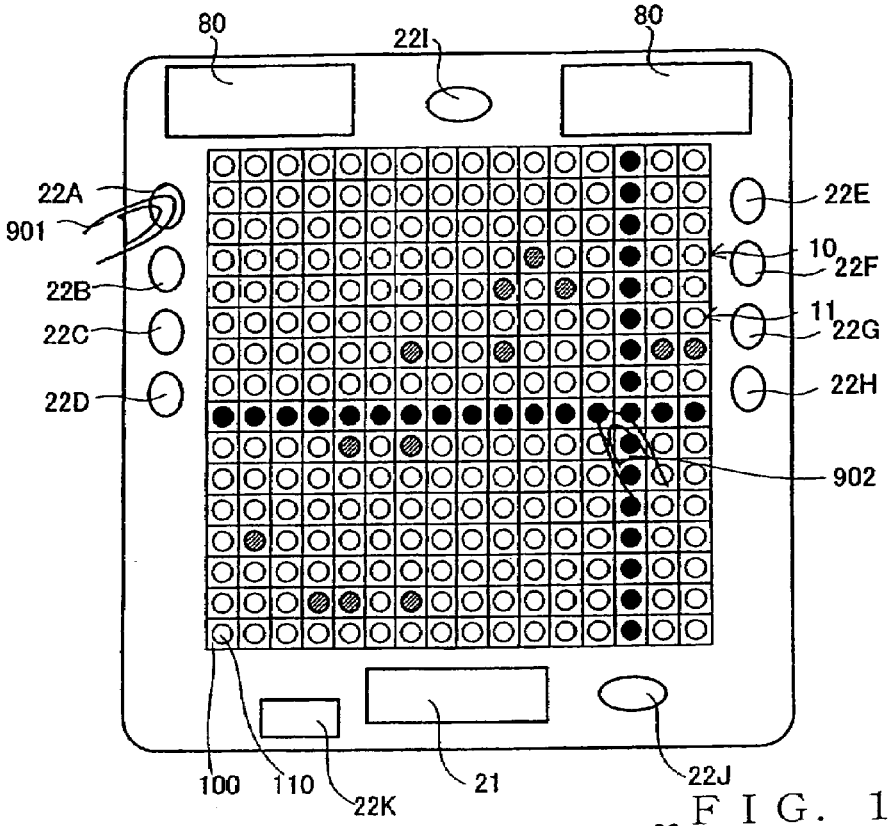
FIGS. 14A and 14B are front views of the performance apparatus at initial and subsequent stages of the tone color adjustment.
Figure 14B:
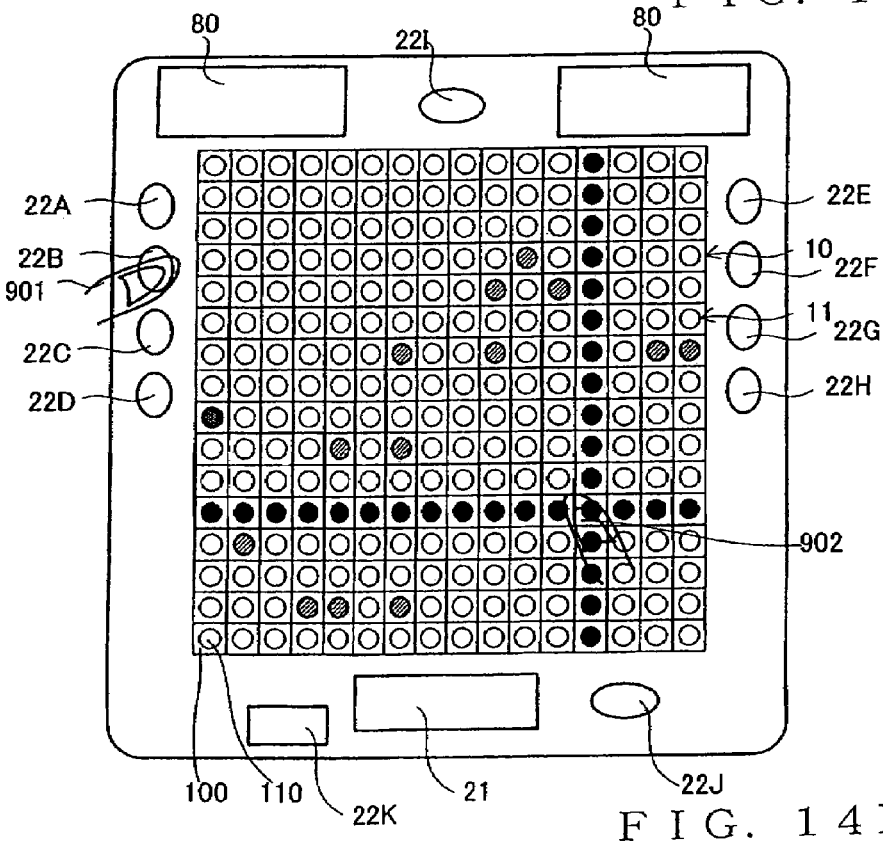

(4) Tone Color Adjustment:

FIG. 13 is a flow chart of tone color adjustment control performed in the performance apparatus 1. FIG. 14A is a front view of the performance apparatus 1 at an initial stage of the tone color adjustment, and FIG. 14B is a front view of the performance apparatus 1 at a subsequent stage (following the initial stage) of the tone color adjustment.

In order to perform desired tone color adjustment, the user depresses the tone color control switch 22A with a finger 901. The main CPU 2 detects the depression of the tone color control switch 22A at step S71, and it receives a tone color control command and then performs tone color adjustment control processing on the display input section 9 (step S72).

Then, the user depresses one of the key switches 100 of the matrix display section 9 with another finger 902 while still depressing the tone color control switch 22A with the finger 901. The sub CPU 12 detects the position of the depressed key switch 100 (step S73), gives the identified coordinates (only the Y-coordinate suffices) to the main CPU 2, and illuminates, with the high light intensity, all of the light-emitting display elements 110 of the horizontal row which the depressed key switch 100 belongs to ("cross-shaped high-intensity illumination") (step S74). In the illustrated example of FIG. 14A, all of the light-emitting display elements 110 of the horizontal row (i.e., mtLED(X, 8)) and all of the light-emitting display elements 110 of the vertical column (i.e., mtLED(13, Y)) which the key switch mtSW(13, 8) belongs to are illuminated with the high light intensity.

Simultaneously, the main CPU 2 detects tone color data corresponding to the identified coordinates. Here, tone color data are prestored in the storage section 4, RAM 5 or the like in association with the individual key switches 100 of the matrix display input section 9. The main CPU 2 performs tone color control on the tone generator 6 on the basis of the detected tone color data (step S75).

Such tone color control based on the key switches 100 is performed repetitively until release of the depression of the tone color control switch 22A is detected (S76→S73).

Once the user depresses another key switch 100 as shown in FIG. 14B, the sub CPU 12 detects the coordinates of the depressed key switch 100 and performs tone color control corresponding to the detected coordinates. At that time, if the depressed position changes from one switch key to another, the previous cross-shaped, high-intensity illumination is terminated, and instead the cross-shaped, high-intensity illumination corresponding the newly-depressed key switch 100 is performed, as in the above-described tone pitch control etc.

Then, once release of the depression of the tone color control switch 22A is detected (step 76), the main CPU 2 terminates the tone color adjustment control (S77).

With such processing, the user is allowed to readily adjust the tone color relative to the preset reference tone and thereby perform a music piece with an enhanced degree of freedom. Further, because the tone color adjustment amount can be visually recognized through the position of the cross-shaped illumination, the user is allowed to clearly recognize the selected tone color.

Namely, the instant embodiment arranged in the above-described manner allows music pieces with enhanced elaborateness, originality and degree of freedom to be performed with ease.

Whereas the embodiment has been described as applied to schemes for adjusting a tone pitch, tone length, tone volume and tone color, the basic principles of the invention may be applied to adjustment of any other desired characteristics of a tone. For example, the basic principles of the invention may be applied to adjustment of tone volume balance between left- and right-channel tones output from the speakers 80, in which case the illumination line may be made to extend in the vertical direction.

Further, whereas the key switches in the embodiment has been described as arranged in a matrix of 256 (16×16) key switches, any desired arrangement of the key switches may be chosen in accordance with desired performance.

The tone pitch adjustment, tone color adjustment and/or tone volume adjustment of the present invention may be performed either individually for each of the key switches, or uniformly for all of the key switches so that common adjustment is applied to all of the key switches.

Further, the apparatus of the present invention need not necessarily have a tone generator device provided therein; in this case, tone generation instructing information (e.g., MIDI command) may be output from the apparatus of the present invention and supplied to an external tone generator device.

What is claimed is:

1. A performance apparatus comprising:

a plurality of key switches arranged two-dimensionally, each key switch being assigned a tone pitch;

a memory storing tone data corresponding to said plurality of key switches;

a tone generation section that, on the basis of the tone data stored in said memory, generates a tone corresponding to any actuated key switch among said plurality of key switches;

a mode setting section that actuates a tone adjusting mode for causing the key switches to function as tone-adjusting operators for each tone to be generated by said tone generation section; and a tone adjustment section that adjusts with at least one of the key switches, while the tone adjusting mode is actuated, a predetermined tone factor of each tone to be generated;

a light-emitting element associated with each of said plurality of key switches; and a light emission control section that controls light emission of the light-emitting elements to illuminate in a line all of the light-emitting elements located at an X- or Y-coordinate position of any actuated key switch for adjusting the predetermined tone factor.

2. The performance apparatus as claimed in claim 1, wherein said tone adjustment section adjusts the predetermined tone factor in accordance with a two-dimensional coordinate position of one of the key switches or a difference between two-dimensional coordinate positions of at least two of the key switches.

3. The performance apparatus as claimed in claim 1, wherein the predetermined tone factor is any one of tone pitch, tone length, tone volume, or tone color.

4. The performance apparatus as claimed in claim 3, wherein said mode setting section includes a plurality of predetermined control switches for actuating any one tone factor from among the tone pitch, tone length, tone volume, and tone color as the predetermined tone factor.

5. The performance apparatus as claimed in claim 1, wherein said mode setting section includes at least one predetermined control switch for actuating the tone adjusting mode.

6. The performance apparatus as claimed in claim 1, wherein said tone adjustment section adjusts the predetermined tone factor in accordance with an X- or Y-coordinate position of the at least one key switch.

7. The performance apparatus as claimed in claim 1, wherein said tone adjustment section adjusts the predetermined tone factor in accordance with X- or Y-coordinate positions of at least two of the key switches.

8. The performance apparatus as claimed in claim 1, wherein the tone adjusting mode has a plurality of tone factors, when one of the tone factors is to be adjusted, said tone adjustment section adjusts the one tone factor in accordance with a difference between X-coordinate positions of at least two of the key switches, and when another one of the tone factors is to be adjusted, said tone adjustment section adjusts the another tone factor in accordance with a difference between Y-coordinate positions of at least two of the key switches.

9. The performance apparatus as claimed in claim 1, wherein the light emission control section further controls light emission of the light-emitting elements in response to actuation of the at least one key switch for adjusting the predetermined tone factor.

10. The performance apparatus as claimed in claim 1, further comprising a storage section that stores ON/OFF states of said plurality of key switches in correspondence with a desired music performance, and a readout control section that reads out the ON/OFF states of said plurality of key switches from said storage section in response to a reproductive performance instruction, and wherein said tone generation section generates tones corresponding to the key switches designated in accordance with the ON/OFF states read out via said readout control section.

11. A performance apparatus comprising:

a plurality of key switches arranged two-dimensionally;

a memory storing tone data corresponding to said plurality of key switches;

a tone generation section that, on the basis of the tone data stored in said memory, generates a tone corresponding to a key switch actuated among said plurality of key switches;

a mode setting section that actuates a tone adjusting mode for causing the key switches to function as tone-adjusting operators for the tone to be generated by said tone generation section;

a tone adjustment section that adjusts, while the tone adjusting mode is actuated, a predetermined tone factor of the tone with at least one of the key switches;

a light-emitting element associated with each of said plurality of key switches; and a light emission control section that controls light emission of the light-emitting elements with the at least one key switch, wherein said tone adjustment section adjusts the predetermined tone factor in accordance with an X- or Y-coordinate position of one of the key switches for adjusting the predetermined tone factor, or in accordance with a difference between X- or Y-coordinate positions of at least two of the key switches for adjusting the predetermined tone factor, and wherein said light emission control illuminates in a line all of the light-emitting elements located at the X- or Y-coordinate position of each of the key switches actuated for adjusting the predetermined tone factor.

12. A method of generating a tone with a performance apparatus including a plurality of key switches arranged two-dimensionally, each key switch being assigned a tone pitch, a memory storing tone data corresponding to the plurality of key switches, and a light-emitting element associated with each of said plurality of key switches, the method comprising:

a tone generation step of, on the basis of the tone data stored in the memory, generating a tone corresponding to any key switch actuated among the plurality of key switches;

a step of actuating a tone adjusting mode for causing the key switches to function as tone-adjusting operators for each tone to be generated by said tone generation step;

a tone adjustment step of adjusting with at least one of the key switches, while the tone adjusting mode is actuated, a predetermined tone factor of each tone to be generated;

a control step of controlling the light-emitting elements to illuminate in a line all of the light-emitting elements located at an X- or Y-coordinate position of any actuated key switch for adjusting the predetermined tone factor.

13. The method as claimed in claim 12, wherein said tone adjustment step adjusts the predetermined tone factor in accordance with a two-dimensional coordinate position of one of the key switches actuated or a difference between two-dimensional coordinate positions of at least two of the key switches actuated successively.

14. The method as claimed in claim 12, wherein the predetermined tone factor is any one of tone pitch, tone length, tone volume, or tone color.

15. The method as claimed in claim 12, wherein said mode setting step actuates the tone adjusting mode in response to actuation of a predetermined control switch.

16. The method as claimed in claim 12, wherein the control step further controls light emission of the light-emitting elements with the at least one key switch for adjusting the predetermined tone factor.

17. A computer-readable medium storing a computer program for controlling a performance apparatus including a plurality of key switches arranged two-dimensionally, each key switch being assigned a tone pitch, a memory storing tone data corresponding to the plurality of key switches, and a light-emitting element associated with each of said plurality of key switches the computer program containing:

a tone generation instruction for, on the basis of the tone data stored in the memory, generating a tone corresponding to any key switch actuated among the plurality of key switches;

a setting instruction for actuating a tone adjusting mode for causing the key switches to function as tone-adjusting operators for each tone to be generated by said tone generation instruction;

a tone adjustment instruction for adjusting with at least one of the key switches, while the tone adjusting mode is actuated, a predetermined tone factor of each tone to be generated; and a control instruction for controlling the light-emitting elements to illuminate in a line all of the light-emitting elements located at an X- or Y-coordinate position of any actuated key switch for adjusting the predetermined tone factor.

18. The computer-readable medium as claimed in claim 17, wherein said tone adjustment instruction adjusts the predetermined tone factor in accordance with a two-dimensional coordinate position of one of the key switches or a difference between two-dimensional coordinate positions of at least two of the key switches.

19. The computer-readable medium as claimed in claim 17, wherein the predetermined tone factor is any one of tone pitch, tone length, tone volume, or tone color.

20. The computer-readable medium as claimed in claim 17, wherein said mode setting instruction actuates the tone adjusting mode in response to actuation of a predetermined control switch.

21. The computer-readable medium as claimed in claim 17, wherein the control instruction further controls light emission of the light-emitting elements with the at least one key switch for adjusting the predetermined tone factor.

* * * * *

UNITED STATES PATENT AND TRADEMARK OFFICE

CERTIFICATE OF CORRECTION

PATENT NO. : 7,394,010 B2
APPLICATION NO. : 11/493739
DATED : July 1, 2008
INVENTOR(S) : Yu Nishibori et al.

It is certified that error appears in the above-identified patent and that said Letters Patent is hereby corrected as shown below:

On the Title Page, Item (56) Other Publications Field: the second listed publication should read:

--Notice of Grounds for Rejection issued in corresponding Japanese Patent Application No. 2005-109598, with mailing date Feb. 27,2007.--

Signed and Sealed this

Nineteenth Day of August, 2008

JON W. DUDAS
*Director of the United States Patent and Trademark Office*